US010967651B2

(12) United States Patent
Aizawa

(10) Patent No.: US 10,967,651 B2
(45) Date of Patent: Apr. 6, 2021

(54) PRINTER AND PRINTER DISPLAY DEVICE

(71) Applicant: Seiko Instruments Inc., Chiba (JP)

(72) Inventor: Kazuyuki Aizawa, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/697,735

(22) Filed: Nov. 27, 2019

(65) Prior Publication Data

US 2020/0180330 A1 Jun. 11, 2020

(30) Foreign Application Priority Data

Dec. 11, 2018 (JP) ..... JP2018-231685

(51) Int. Cl.

| | |
|---|---|
| ***B41J 15/04*** | (2006.01) |
| ***B41J 3/36*** | (2006.01) |
| ***B41J 3/46*** | (2006.01) |
| ***B41J 29/02*** | (2006.01) |
| ***B41J 29/13*** | (2006.01) |
| ***G07G 5/00*** | (2006.01) |
| ***G09G 5/00*** | (2006.01) |

(52) U.S. Cl.

CPC . *B41J 3/46* (2013.01); *B41J 3/36* (2013.01); *B41J 15/042* (2013.01); *B41J 29/02* (2013.01); *B41J 29/13* (2013.01); *G07G 5/00* (2013.01); *G09G 5/003* (2013.01)

(58) Field of Classification Search

CPC ..... B41J 15/042; B41J 3/36; B41J 29/02

See application file for complete search history.

(56) References Cited

U.S. PATENT DOCUMENTS 5,513,922 A * 5/1996 Umbach ..... B41J 3/46 347/222
2011/0261394 A1 10/2011 Tanaka
2017/0021651 A1 1/2017 Yamamoto et al.

FOREIGN PATENT DOCUMENTS

| | | | |
|---|---|---|---|
| EP | 3075557 | A2 | 10/2016 |
| EP | 3075557 | A3 | 1/2017 |
| JP | 2011-042125 | A | 3/2011 |
| JP | 2011-230330 | A | 11/2011 |

OTHER PUBLICATIONS

Extended European Search Report in Europe Application No. 19215205.6, dated Apr. 9, 2020, 9 pages.

* cited by examiner

*Primary Examiner* — Matthew Luu
*Assistant Examiner* — Kendrick X Liu
(74) *Attorney, Agent, or Firm* — Brinks Gilson & Lione

(57) ABSTRACT

A printer includes a printer housing, which includes a plurality of outer surfaces including a bottom surface opposed to an installation surface, and has a recording paper receiving portion configured to receive recording paper through an opening portion; a printer cover, which is coupled to the printer housing, and is configured to openably cover the opening portion; a printer display device, which is removably mounted to the outer surface, of the plurality of outer surfaces, other than the bottom surface, and is configured to display predetermined information; and a connection cable, which is connected between the printer housing and the printer display device, and is configured to communicate at least data related to the predetermined information. The printer display device has a cable groove in which the connection cable is fitted and received.

11 Claims, 21 Drawing Sheets

PRINTER AND PRINTER DISPLAY DEVICE

RELATED APPLICATIONS

This application claims priority to Japanese Patent Application No. 2018-231685 filed on Dec. 11, 2018, the entire content of which is incorporated herein by reference.

BACKGROUND OF THE INVENTION

1. Field of the Invention

The present invention relates to a printer and a printer display device.

2. Description of the Related Art

As an apparatus for, for example, inputting sales, receiving or paying money, or issuing a receipt in various kinds of stores and the like, a POS system configured to manage a point-of-sale system (POS) has hitherto been adopted. This type of POS system includes, for example, a POS terminal, a printer, a display device such as a liquid crystal display, and peripheral equipment such as a cash drawer.

As the printer forming the POS system, various types have been known. For example, a printer connected to a display device through a connection cable or the like has been known.

As a printer of this kind, there has been known, for example, a printer stand that includes a support portion configured to removably support a printer (thermal printer) on a front surface side and removably support a display device on a back surface side. This printer stand can mainly exhibit two functions: a printer support function of supporting the printer in a posture different from an installation posture (for example, a horizontal posture) of the independent printer; and an advertising function as an advertising medium or the like for displaying various kinds of information through the display device.

As another printer, there has also been known, for example, a printer connected to a self-standing display device through a connection cable or the like.

However, in the case of the printer stand, the printer and the display device are supported by the printer stand, and hence it is required to secure installation space of the printer stand itself having a large size in order to install the printer and the display device. Therefore, it is required to secure large installation space, and an installation position is liable to be limited. Thus, there is room for improvement. Further, the printer stand configured to support the printer and the display device is required in addition to the printer and the display device, and hence the number of components is increased accordingly, which is liable to cause an increase in cost.

In addition, even in the case of the related-art printer connected to the self-standing display device, it is required to secure each installation position of the printer and the display device, and hence large installation space is also required. Further, the display device itself may fall down, with the result that there is an increased risk leading to a defect, and the reliability of installation is not sufficient.

Further, a connection cable for power feeding or communication is laid under a state of being exposed between the printer and the display device, and hence the connection cable is liable to be conspicuous. Therefore, the appearance on the periphery of a cash desk at a shop is liable to be impaired, and hence there is room for improvement. Further, through exposure of the connection cable, contact with the connection cable is liable to occur. Therefore, there is a risk in that the printer or the display device be displaced or fall down due to the contact with the connection cable, and there is also a risk in that unexpected dropping (removal) and the like of the connection cable may occur. Therefore, there is still room for improvement.

In view of the above-mentioned circumstances, in this type of technical field, there has been a demand for a printer and a printer display device in which space and cost can be saved, and exposure of the connection cable can be prevented.

SUMMARY OF THE INVENTION

According to one embodiment of the present invention, there is provided a printer, including a printer housing, which includes a plurality of outer surfaces including a bottom surface opposed to an installation surface, and has a recording paper receiving portion configured to receive recording paper through an opening portion; a printer cover, which is coupled to the printer housing, and is configured to openably cover the opening portion; a printer display device, which is removably mounted to the outer surface, of the plurality of outer surfaces, other than the bottom surface, and is configured to display predetermined information; and a connection cable, which is connected between the printer housing and the printer display device, and is configured to communicate at least data related to the predetermined information, wherein the printer display device has a cable groove in which the connection cable is fitted and received.

In the above-mentioned printer according to the one embodiment, wherein the printer housing includes, as the plurality of outer surfaces, at least a front surface and a back surface opposed to each other, wherein the printer cover is provided on the front surface, and wherein the printer display device is separably mounted to the back surface.

In the above-mentioned printer according to the one embodiment, wherein the printer display device includes a fixing portion separably mounted to the outer surface; a display portion main body, which has a display portion configured to display the predetermined information provided thereon, and to which the connection cable is connected; a hinge portion, which has a rotation axis, and is configured to couple the fixing portion and the display portion main body to each other so that the display portion main body is rotated about the rotation axis with respect to the fixing portion, and wherein the cable groove includes a first cable groove formed in the hinge portion so as to extend along the rotation axis; a second cable groove, which is formed in the fixing portion, and communicates to one groove end part of the first cable groove along a direction of the rotation axis; and a third cable groove, which is formed in the display portion main body, and communicates to another groove end part of the first cable groove along the direction of the rotation axis and communicates to a connecting portion between the connection cable and the display portion main body.

In the above-mentioned printer according to the one embodiment, wherein the hinge portion includes a first hinge portion formed integrally with the fixing portion; and a second hinge portion, which is formed integrally with the display portion main body and arranged so as to be adjacent to the first hinge portion in the direction of the rotation axis, and is coupled to the first hinge portion so as to be relatively rotated about the rotation axis, and wherein the first cable groove includes a first groove portion, which is formed in the first hinge portion, and communicates to the second cable groove; and a second groove portion, which is formed in the second hinge portion and coupled to the third cable groove, and has an opening that is to be changed in direction in association with rotation of the second hinge portion, and wherein the opening of the second groove portion is directed in the same direction as a direction of an opening of the first groove portion when the display portion main body is rotated by a predetermined specific rotation angle about the rotation axis with respect to the fixing portion.

In the above-mentioned printer according to the one embodiment, wherein the rotation axis extends in parallel to each of the installation surface and the outer surface to which the printer display device is mounted.

In the above-mentioned printer according to the one embodiment, wherein the printer housing further includes, as the plurality of outer surfaces, a top surface opposed to the bottom surface, and wherein the display portion main body is configured to be displaced by rotation about the rotation axis between a first position at which the display portion main body is overlapped with the fixing portion and a second position at which the display portion is positioned above the top surface.

In the above-mentioned printer according to the one embodiment, wherein the display portion main body is configured to be rotated within a rotation angle range of 180° about the rotation axis from the first position, and wherein the second position is set to be a position at which the display portion main body is rotated by 135° or more about the rotation axis from the first position.

According to one embodiment of the present invention, there is provided a printer display device which is separably mounted to a printer through intermediation of an outer surface other than a bottom surface, and has at least data related to predetermined information communicated thereto through a connection cable connected between a printer housing and the printer display device, the printer including the printer housing, which includes a plurality of outer surfaces including the bottom surface opposed to an installation surface, and has a recording paper receiving portion configured to receive recording paper through an opening portion; and a printer cover, which is coupled to the printer housing, and is configured to openably cover the opening portion, the printer display device comprising a cable groove in which the connection cable is fitted and received.

DETAILED DESCRIPTION OF THE PREFERRED EMBODIMENTS

Now, an embodiment of the present invention is described with reference to the drawings. In this embodiment, description is given of an example of a thermal printer to be used in a POS system.

Figure 1:
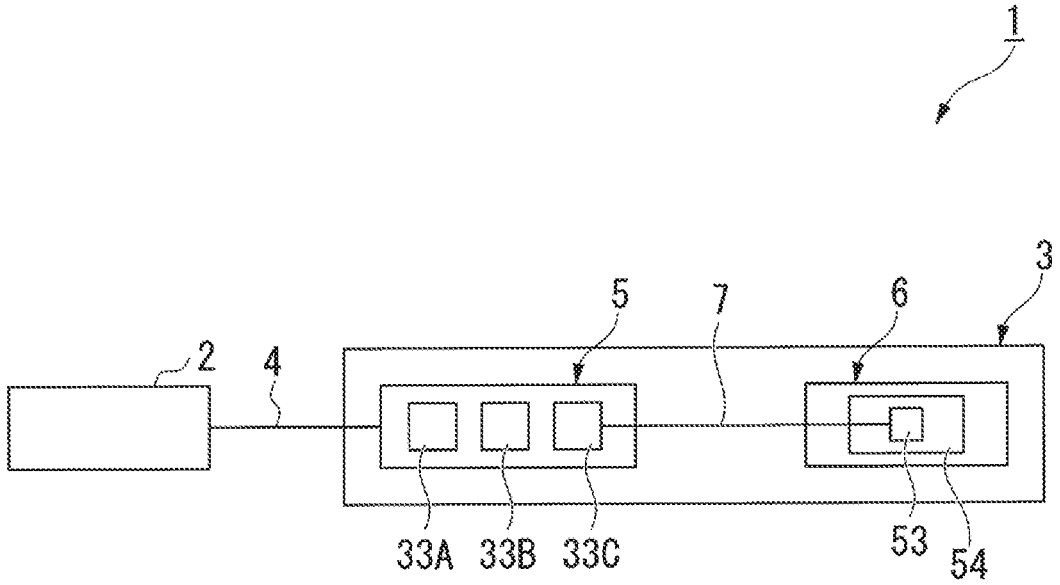
FIG. 1 is a block diagram of a POS system including a thermal printer (printer) according to a first embodiment of the present invention.

As illustrated in FIG. 1, a POS system 1 is a system configured to add up sales results of articles and the like on a single item basis, and mainly includes an information processing device 2 and a thermal printer 3. The POS system 1 is installed in various kinds of stores such as a convenience store, a retail store, and a restaurant. In addition, the POS system 1 is configured to display, to customers, various kinds of information including payment information such as names and prices of articles purchased by the customers at a store. The POS system 1 may further include another peripheral equipment as well as the information processing device 2 and the thermal printer 3.

Examples of the information processing device 2 include a desktop type personal computer and a tablet type personal computer, but are not limited thereto. The information processing device 2 and the thermal printer 3 are directly connected to each other through a connection cable 4 such as a universal serial bus (USB) cable (wired connection). However, the mode of connection is not limited thereto. For example, the information processing device 2 and the thermal printer 3 may be connected to each other by wireless connection through radio communication means or the like, or may be connected to each other through a network.

As illustrated in FIG. 1 to FIG. 4, the thermal printer 3 is configured to perform printing on roll-shaped recording paper (heat sensitive paper) P, and the recording paper P can be used as, for example, a ticket or a receipt. The thermal printer 3 mainly includes a printer main body 5, a printer display device 6, and a USB cable (connection cable according to the present invention) 7. The printer main body 5 is configured to print various kinds of information on the recording paper P. The printer display device 6 is configured to display various kinds of information. The USB cable 7 is connected between the printer main body 5 and the printer display device 6, and is configured to communicate at least data related to various kinds of information.

The thermal printer 3 is installed, for example, at a store, and the operation thereof is controlled by the information processing device 2. Therefore, the printer main body 5 is controlled so as to print various kinds of information sent from the information processing device 2 onto the recording paper P and deliver the printed recording paper P. In addition, the printer display device 6 is controlled so as to display various kinds of information sent from the information processing device 2.

Figure 2:
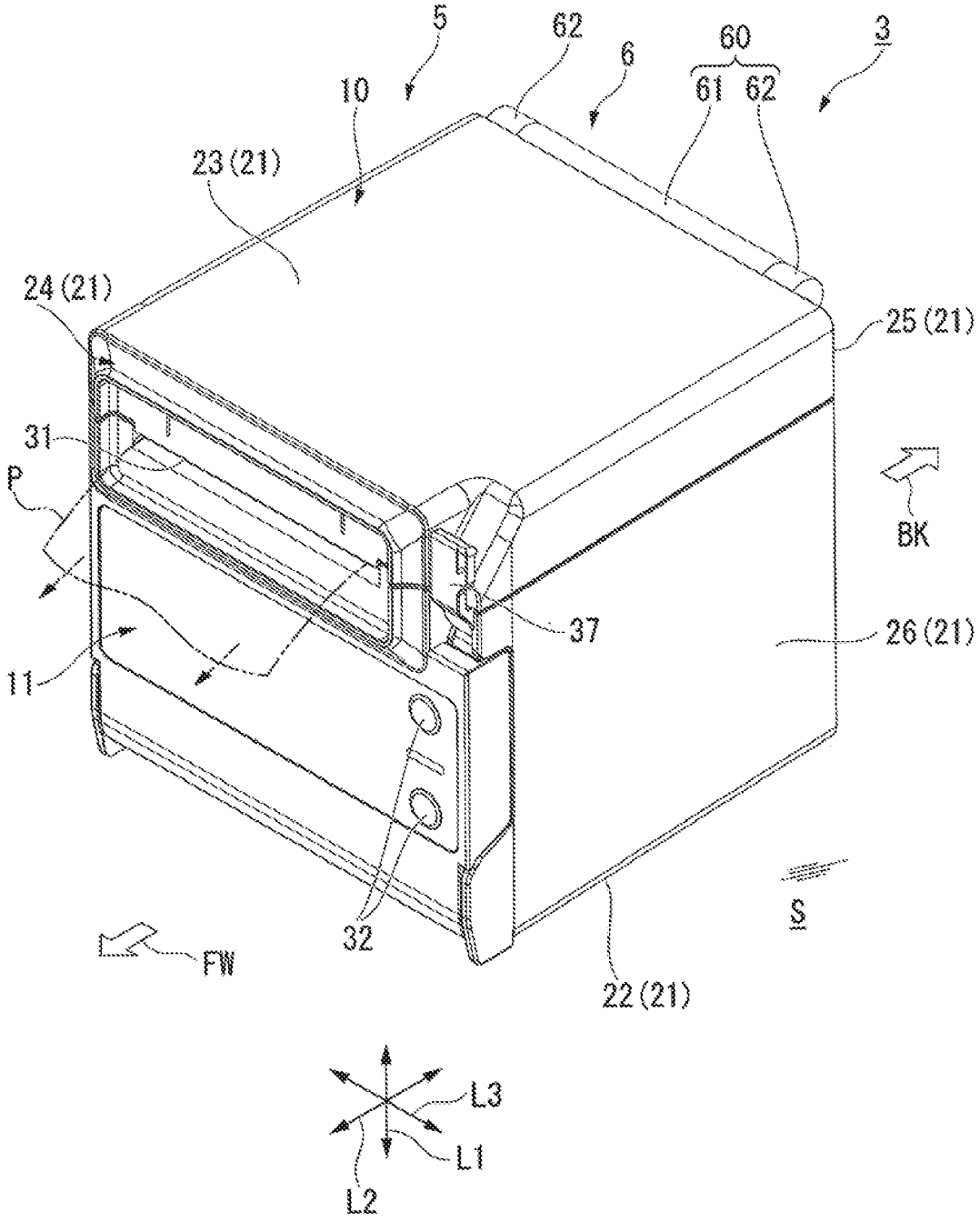
FIG. 2 is a perspective view of the thermal printer illustrated in FIG. 1 when viewed from a front surface side.
Figure 3:
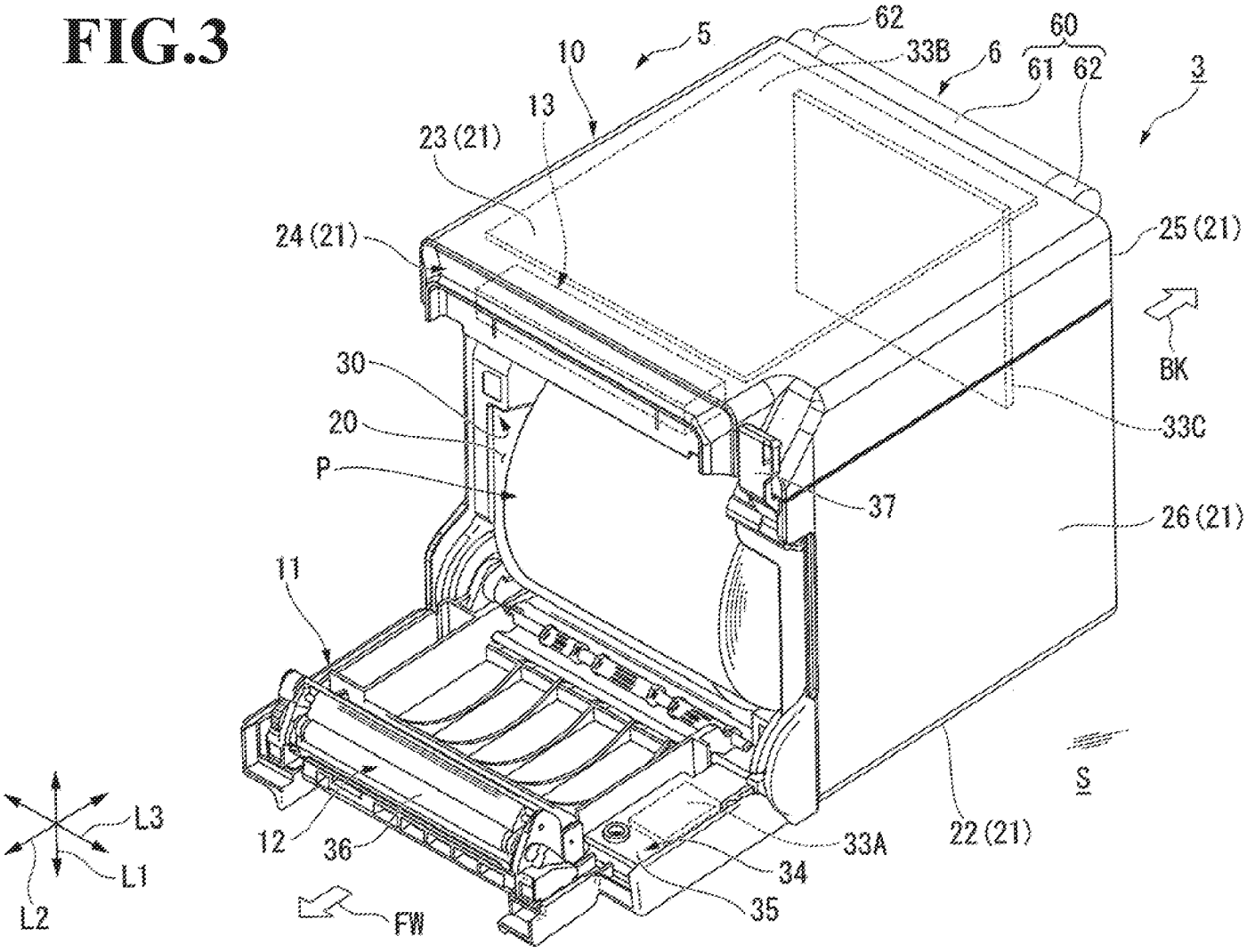
FIG. 3 is a perspective view of the thermal printer in a state in which a printer cover is opened from the state illustrated in FIG. 2.
Figure 4:
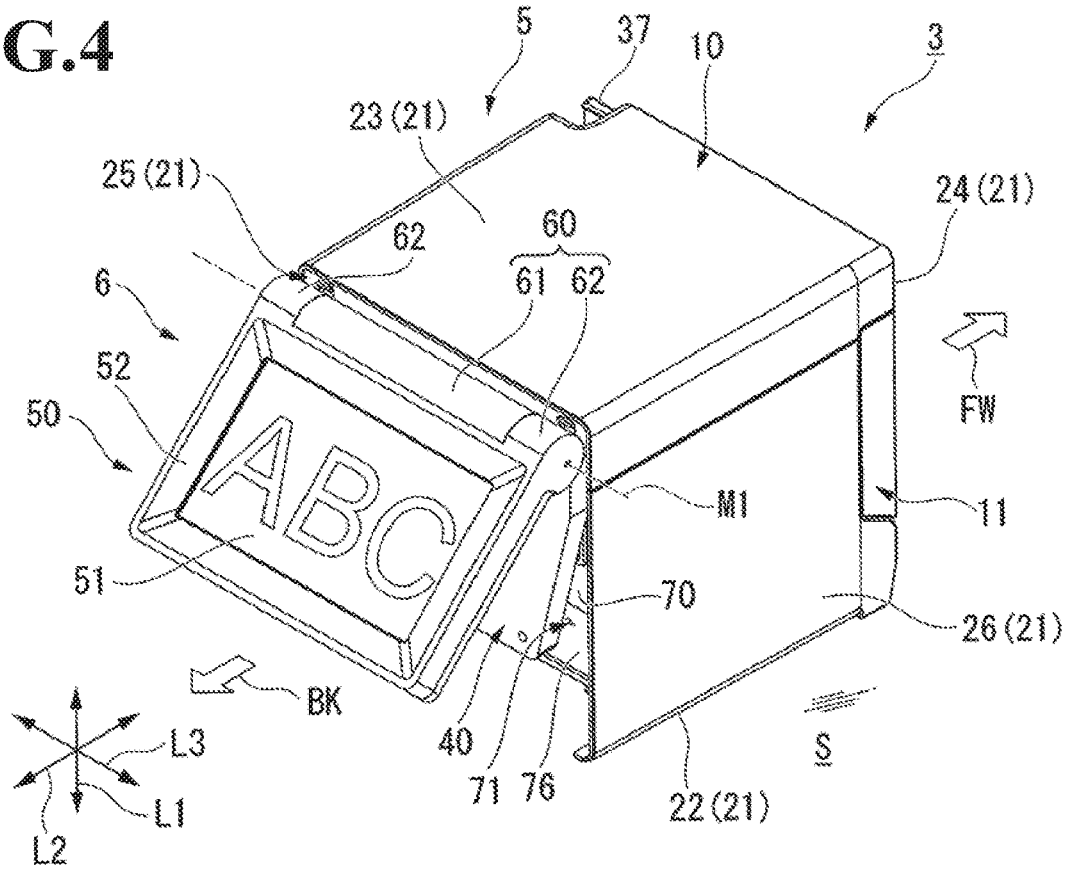
FIG. 4 is a perspective view of the thermal printer illustrated in FIG. 2 when viewed from a back surface side.

As illustrated in FIG. 2 to FIG. 4, the thermal printer 3 is installed on an installation surface S at the store, and has a cubic shape as a whole. In this embodiment, in a state illustrated in FIG. 2, a direction perpendicular to the installation surface S is referred to as "up-and-down direction L1", and directions orthogonal to each other in a plane parallel to the installation surface S are referred to as "front-and-back direction L2" and "right-and-left direction L3". In the front-and-back direction L2, a front side is indicated by the arrow FW, and a back side is indicated by the arrow BA. Thus, in FIG. 2, a lower left side on the drawing sheet corresponds to the front side, and an upper right side on the drawing sheet corresponds to the back side.

The printer main body 5 includes a casing (printer housing according to the present invention) 10, a printer cover 11, a platen unit 12, and a head unit 13, and is a so-called forward delivery type in which the recording paper P is delivered to the front side.

The casing 10 is formed with a synthetic resin material, a metal material, or an appropriate combination of those materials, has a cubic shape including an opening portion 20 on the front side. The casing 10 has a plurality of outer surfaces 21 including a bottom surface 22 opposed to the installation surface S. Of the plurality of outer surfaces 21, the outer surface 21 opposed to the bottom surface 22 in the up-and-down direction L1 is referred to as "top surface 23". In addition, of the plurality of outer surfaces 21, the outer surface 21 positioned on the front side is referred to as "front surface 24", and the outer surface 21 positioned on the back side is referred to as "back surface 25". The front surface 24 and the back surface 25 are opposed to each other in the front-and-back direction L2. Further, of the plurality of outer surfaces 21, the outer surfaces 21 opposed to each other in the right-and-left direction L3 are referred to as "pair of side surfaces 26".

In the casing 10, there is formed a recording paper receiving portion 30 configured to receive the roll-shaped recording paper P through the opening portion 20 formed in the front surface 24 of the casing 10. Therefore, the recording paper receiving portion 30 is exposed to the front side when the print cover 11 is opened. With this, the roll-shaped recording paper P can be loaded into the recording paper receiving portion 30 from the front side.

The printer cover 11 is coupled to a lower part of the casing 10 on the front surface 24 side through intermediation of a rotary shaft portion (not shown), and is configured to openably cover the opening portion 20. The printer cover 11 is coupled to the lower part of the casing 10 on the front surface 24 side so as to be rotated about the rotary shaft portion within an angle range of about 90°. As illustrated in FIG. 2, when the printer cover 11 is closed, a slight gap is designed to be formed between a distal end of the printer cover 11 and the casing 10. The recording paper P is pulled out to the front side to be delivered from an inside of the casing 10 through the gap. Thus, the gap serves as a delivery slot 31 for the recording paper P.

As illustrated in FIG. 2 and FIG. 3, an operation unit 34 including operation buttons 32 and an auxiliary board 33A is provided to the printer cover 11 having the configuration described above. The operation buttons 32 are, for example, a power button and a sheet feeding button, and are arranged under a state of being exposed to an outer surface of the printer cover 11 so as to be depressed. In the illustrated example, the operation buttons 32 are arranged below a release lever 37 described later so as to be arrayed in a row in the up-and-down direction L1.

The auxiliary board 33A is a board on which a plurality of electronic components (not shown) and switches (for example, a membrane switch) (not shown) that are turned on by pressing the operation buttons 32 are mounted, and is electrically connected to a main board 33B. As illustrated in FIG. 3, the main board 33B is provided on an inner side of the top surface 23 of the casing 10 in the printer main body 5, and is configured to comprehensively control the operation of the thermal printer 3 based on a control signal from the information processing device 2. The auxiliary board 33A is arranged so as to be positioned on an inner surface side of the printer cover 11 and on a back side of the operation buttons 32, and is covered with a protective cover 35 mounted to the inner surface side of the printer cover 11.

Further, the platen unit 12 is mounted on an inner surface on the distal end side of the printer cover 11. The platen unit 12 mainly includes a platen roller 36 configured to feed the recording paper P to the front side. The platen unit 12 is moved in association with an opening and closing operation of the printer cover 11, and can be combined with the head unit 13.

The head unit 13 mainly includes a thermal head (printing head) (not shown), and is mounted in the casing 10. Specifically, the head unit 13 is mounted above the recording paper receiving portion 30 so as to be close to the front surface 24 of the casing 10. The thermal head is formed so as to extend in a width direction of the recording paper P, and is arranged at a position that is opposed to the platen roller 36 when the printer cover 11 is closed. The thermal head includes a plurality of heating elements linearly arrayed along the width direction of the recording paper P, and is biased to the platen roller 36 side. With this, the recording paper P can be held between the platen roller 36 and the head unit 13, and the thermal head can be appropriately pressed against the recording paper P fed by the platen roller 36, with the result that satisfactory printing can be performed.

When the printer cover 11 is closed, the platen unit 12 and the head unit 13 are combined with each other to be integrally coupled to each other. With this, the printer cover 11 is locked in a closed state. Further, in the casing 10, the release lever 37 is provided at a corner part at which the front surface 24, the top surface 23, and one of the pair of side surfaces 26 intersect each other. The release lever 37 is configured to release a locked state of the printer cover 11 to perform an opening operation of the printer cover 11. For example, the release lever 37 can be operated by being depressed downward, and is configured to release the combination between the head unit 13 and the platen unit 12 in association with the depressing operation. With this, the locked state of the printer cover 11 can be released as illustrated in FIG. 3.

As illustrated in FIG. 4 to FIG. 7, the printer display device 6 is removably mounted to the printer main body 5. The printer display device 6 includes a fixing portion 40, a display portion main body 50, and a hinge portion 60. The fixing portion 40 is removably mounted to the back surface 25 of the casing 10 of the printer main body 5. The display portion main body 50 includes a display portion 51 configured to display various kinds of information. The hinge portion 60 is configured to couple the fixing portion 40 and the display portion main body 50 to each other so that the display portion main body 50 can be displaced relative to the fixing portion 40.

Figure 6:
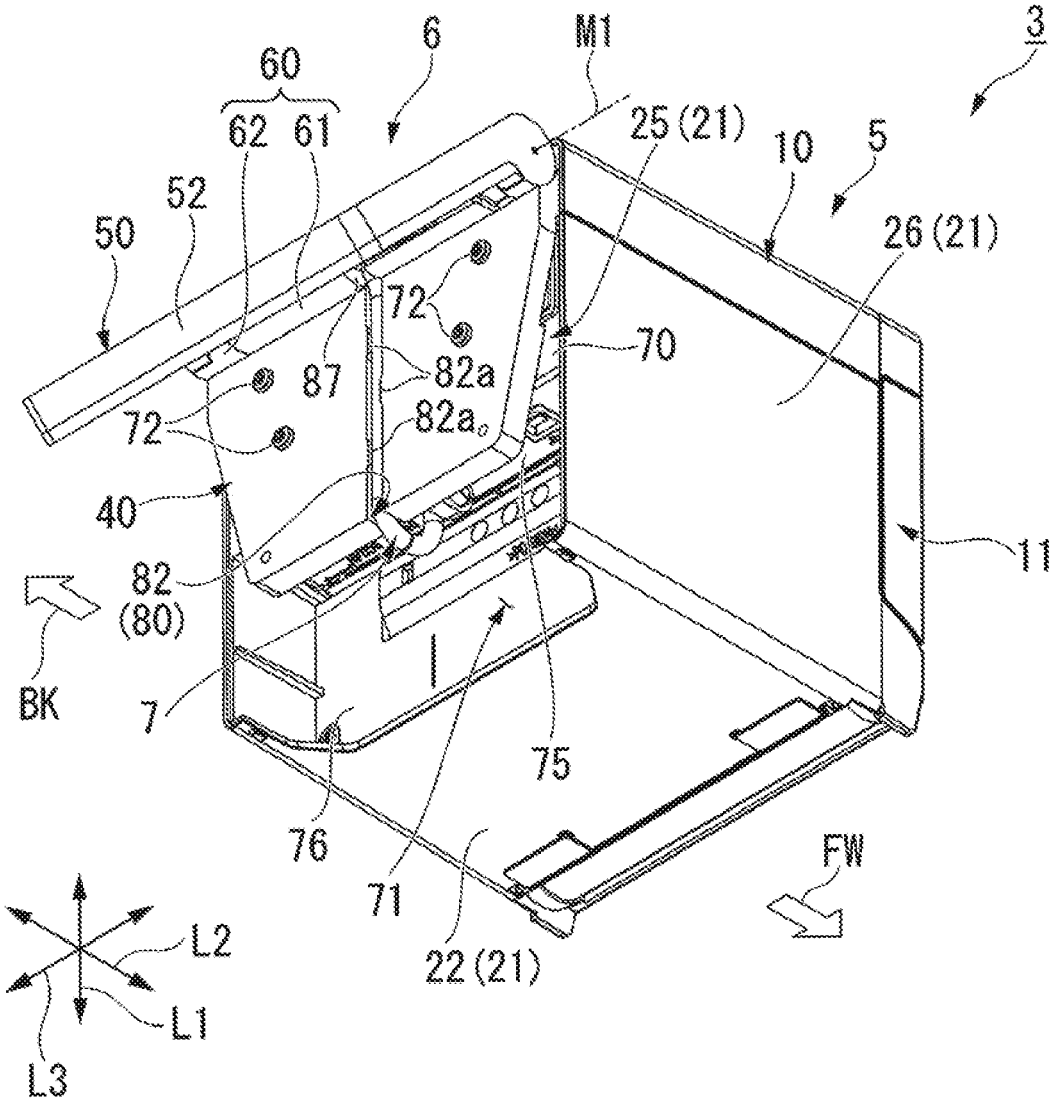
FIG. 6 is a perspective view of the thermal printer illustrated in FIG. 4 when viewed from a bottom surface side.
Figure 7:
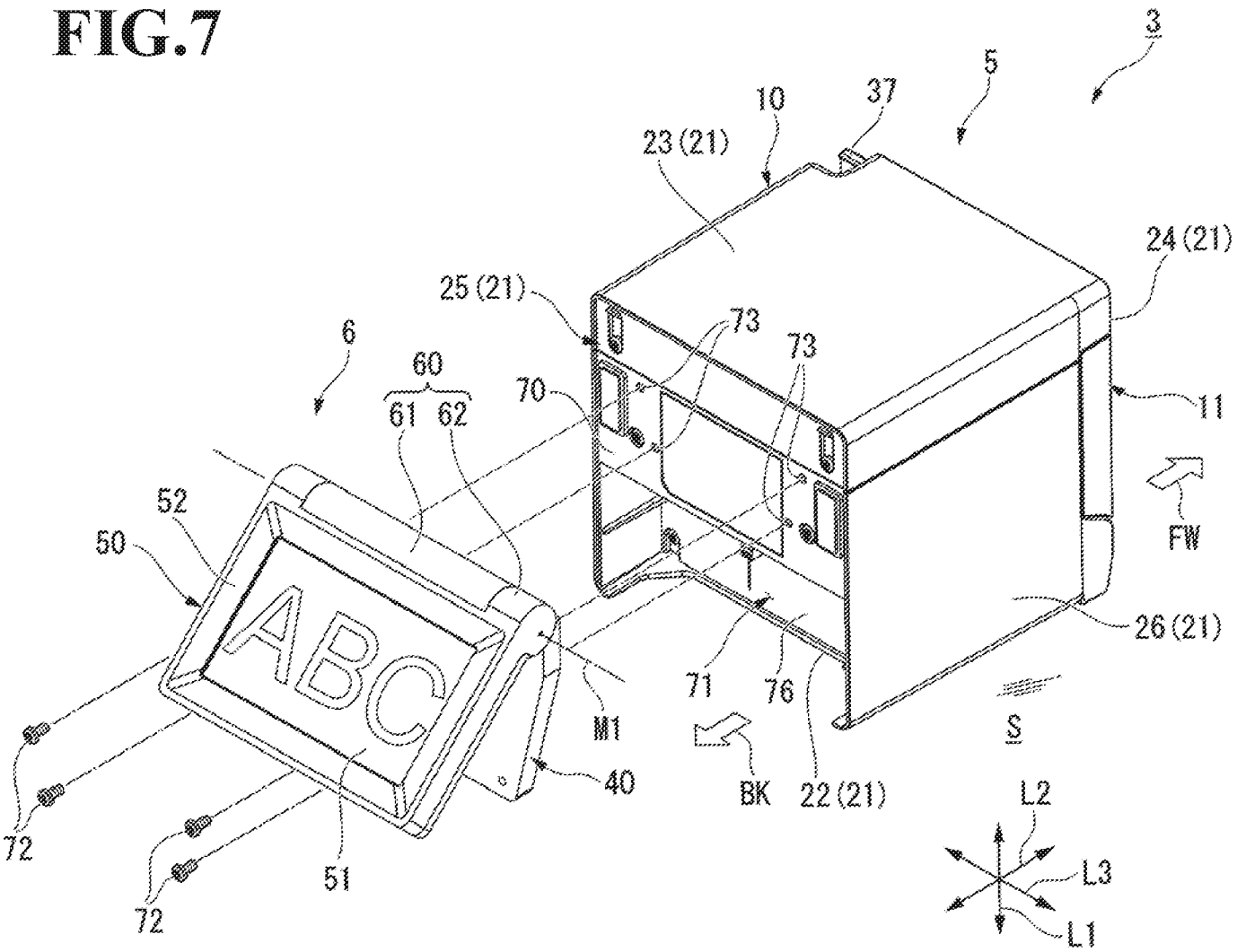
FIG. 7 is a perspective view of the thermal printer in a state in which a printer display device is removed from the state illustrated in FIG. 4.

The back surface 25 side of the casing 10 is briefly described. As illustrated in FIG. 6 and FIG. 7, on the back surface 25 of the casing 10, a mounting surface 70 to which the fixing portion 40 is mounted is formed so as to be positioned in a substantially upper half side of the casing 10, and a connecting recessed portion 71 in which the USB cable 7 is pulled out is formed so as to be positioned below the mounting surface 70. In FIG. 7, the USB cable 7 is omitted.

In this embodiment, the printer display device 6 is mounted to the mounting surface 70 through use of a plurality of (four) fixing screws 72. The number of the fixing screws 72 is not limited to four and may be appropriately changed.

As illustrated in FIG. 7, a plurality of screw holes 73 into which the plurality of fixing screws 72 are respectively screwed are formed on the mounting surface 70. In the illustrated example, four screw holes 73 are formed so as to correspond to the fixing screws 72, and are formed so as to be arrayed at intervals in the right-and-left direction L3 and the up-and-down direction L1, respectively. As illustrated in FIG. 6 and FIG. 7, the connecting recessed portion 71 is formed so as to be recessed toward the front side from the mounting surface 70 and so as to be opened to the lower side. The connecting recessed portion 71 is defined by a first wall surface 75 directed toward the lower side and a second wall surface 76 directed toward the back side. Various kinds of connecting connectors configured to connect the peripheral equipment to the printer main body 5 are provided to the first wall surface 75 and the second wall surface 76.

The USB cable 7 is connected to the back surface 25 side of the casing 10 having the configuration described above so as to be pulled out downward from the first wall surface 75. However, the mode of connection is not limited thereto, and the USB cable 7 may be connected to the back surface 25 side of the casing 10 so as to be pulled out from the second wall surface 76.

Figure 8:
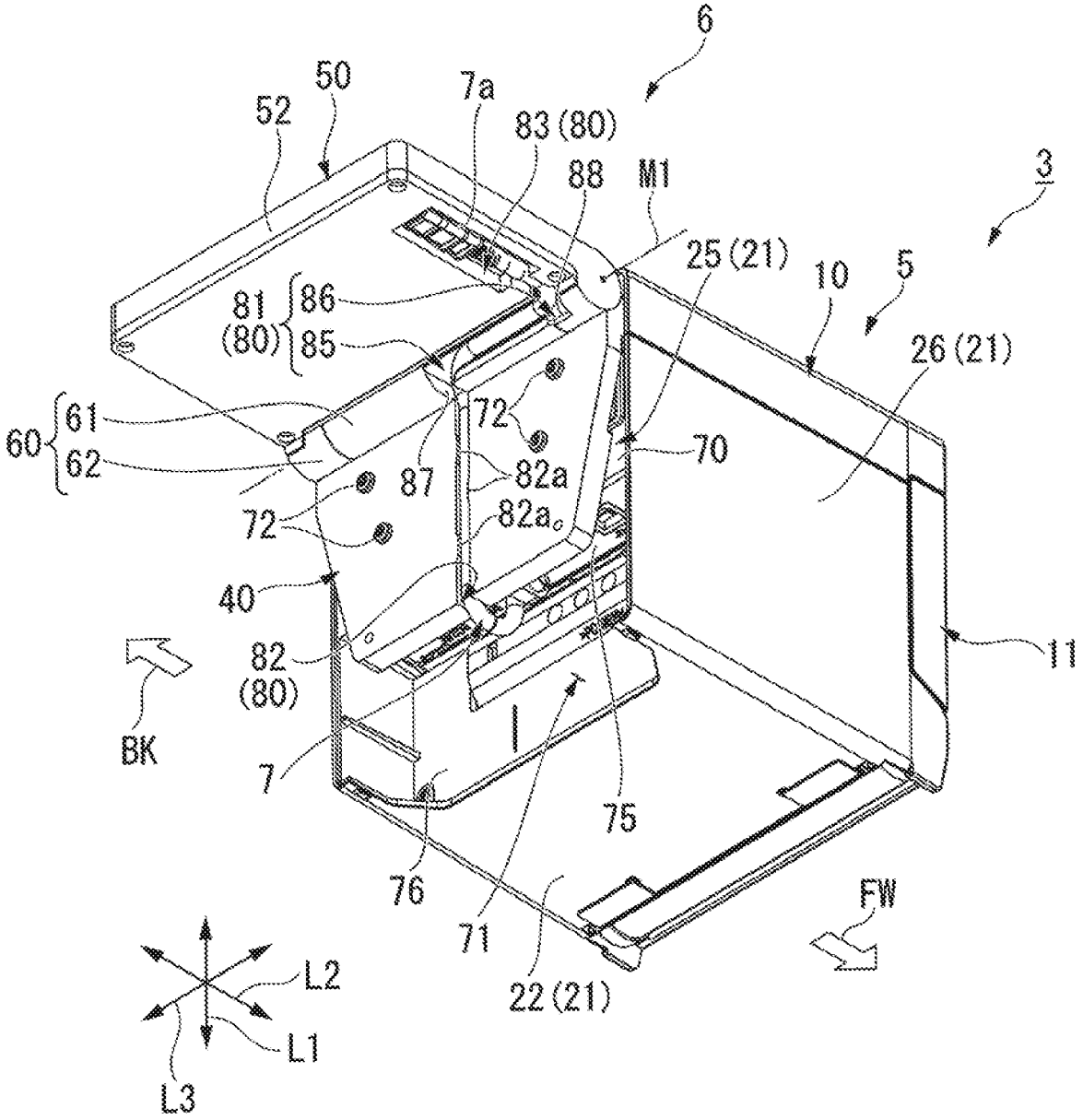
FIG. 8 is a perspective view of the thermal printer in a state in which a display portion main body is rotated upward by 90° from the state illustrated in FIG. 6.

As illustrated in FIG. 8, a male USB connector 7*a* is mounted to a distal end part of the USB cable 7. The USB cable 7 can be removably connected to the display portion main body 50 through intermediation of the USB connector 7*a*. With this, the USB cable 7 connects the casing 10 and the display portion main body 50 to each other. A male USB connector (not shown) may be mounted to a proximal end part of the USB cable 7, and the USB cable 7 may be removably connected to the first wall surface 75 side through intermediation of the USB connector.

The USB cable 7 is arranged on an inner side of the back surface 25 of the casing 10. The USB cable 7 is configured to electrically connect an external connecting board 33C and a display control board 54 described later to each other. The external connecting board 33C is electrically connected to the main board 33B, and the display control board 54 is arranged in the display portion main body 50. The USB cable 7 is configured to communicate at least data (communication signal) related to various kinds of information to be displayed on the display portion 51. In this embodiment, the USB cable 7 serves also to supply power from the printer main body 5 side to the display portion main body 50 side. However, the supply of power to the display portion main body 50 (power supply method) is not limited thereto. For example, power may be supplied from the peripheral equipment other than the printer main body 5. Alternatively, a power source portion such as a secondary battery may be built in the display portion main body 50 so that power is supplied from the power source portion.

Now, the printer display device 6 is described in detail. As illustrated in FIG. 4 to FIG. 7, the fixing portion 40 has a plate shape to be overlapped with the mounting surface 70 from the back side. In the illustrated example, the fixing portion 40 is formed so that a lateral width thereof along the right-and-left direction L3 is smaller than a lateral width of the casing 10, and has a trapezoidal shape in plan view in which the lateral width is gradually decreased from the upper side toward the lower side. However, the shape of the fixing portion 40 is not limited thereto, and may be appropriately changed. The fixing portion 40 has a plurality of insertion holes (not shown) into which the fixing screws 72 are inserted. The insertion holes are formed so as to correspond to the number and positions of the screw holes 73 formed in the mounting surface 70.

Thus, the fixing portion 40 can be fixed to the mounting surface 70 by screwing the fixing screws 72 into the screw holes 73 through the insertion holes. In addition, the fixing portion 40 can be removed from the mounting surface 70 by removing the fixing screws 72. The printer display device 6 can be removably mounted to the back surface 25 of the casing 10 of the printer main body 5 through use of the fixing screws 72. In particular, through use of the fixing screws 72, the fixing portion 40 can be firmly fixed to the mounting surface 70 under a state of being appropriately brought into contact therewith. Thus, the printer display device 6 can be mounted with reduced backlash, and a stable mounting state can be maintained.

The display portion main body 50 includes a display case 52 having a rectangular shape in plan view having a predetermined thickness. The display case 52 has a rectangular shape that is longer in the right-and-left direction L3 than in the up-and-down direction L1. In the illustrated example, the display case 52 is formed so that the lateral width thereof along the right-and-left direction L3 is slightly larger than that of the fixing portion 40 and is smaller than that of the casing 10. Thus, the printer display device 6 is designed so as to be received within the lateral width size of the casing 10.

In the display case 52, there are provided the display portion 51 configured to display various kinds of information and the display control board 54 (not shown) (see FIG. 1) having a display control portion 53 configured to control the display portion 51 mounted thereon. The display control portion 53 is configured to control the display portion 51 to display information, for example, based on data related to various kinds of information sent through the USB cable 7.

The display portion 51 is arranged so as to be exposed in a large area on a front surface side of the display case 52. Examples of the display portion 51 include a color or monochromatic liquid crystal display (LCD) configured to perform segment display, a monochromatic or full-color high-definition liquid crystal display, and an organic EL display. However, the kind of the display portion 51 is not limited thereto, and another kind may be adopted as long as various kinds of information can be displayed. Further, for example, when a liquid crystal display, an organic EL display, or the like is adopted as the display portion 51, the display portion 51 may also include various kinds of functions such as a stereoscopic image display function and a touch panel function. In this case, it is only required that the display portion 51 adaptable to each function be appropriately selected, and various kinds of programs and the like be incorporated into the display control portion 53 so that each function is exhibited.

An upper end part of the fixing portion 40 having the configuration described above and an upper end part of the display case 52 of the display portion main body 50 are coupled to each other through intermediation of the hinge portion 60. The hinge portion 60 has a rotation axis M1 that extends in parallel to each of the installation surface S and the back surface 25 of the casing 10, that is, along the right-and-left direction L3. With this, the display portion main body 50 is coupled to the fixing portion 40 so as to be rotated about the rotation axis M1 through intermediation of the hinge portion 60.

The hinge portion 60 is described in detail. As illustrated in FIG. 4, the hinge portion 60 includes a first hinge portion 61 and a pair of second hinge portions 62. The first hinge portion 61 is formed integrally with the upper end part of the fixing portion 40. The pair of second hinge portions 62 are formed integrally with the upper end part of the display case 52 and arranged on both sides in the right-and-left direction L3 with respect to the first hinge portion 61.

The first hinge portion 61 has a cylindrical shape extending along the right-and-left direction L3 and arranged in a center part of the fixing portion 40 in the right-and-left direction L3 under a state of being arranged coaxially with the rotation axis M1. The pair of second hinge portions 62 each have a topped cylindrical shape extending along the right-and-left direction L3 in the same manner as in the first hinge portion 61 and arranged so as to be adjacent to both sides of the first hinge portion 61 in the right-and-left direction L3 under a state of being arranged coaxially with the rotation axis M1.

The first hinge portion 61 and the pair of second hinge portions 62 are coupled to each other through intermediation of a rotary shaft (not shown) extending along the rotation axis M1. With this, the pair of second hinge portions 62 are coupled to the first hinge portion 61 so as to be relatively rotated about the rotation axis M1.

Figure 9:
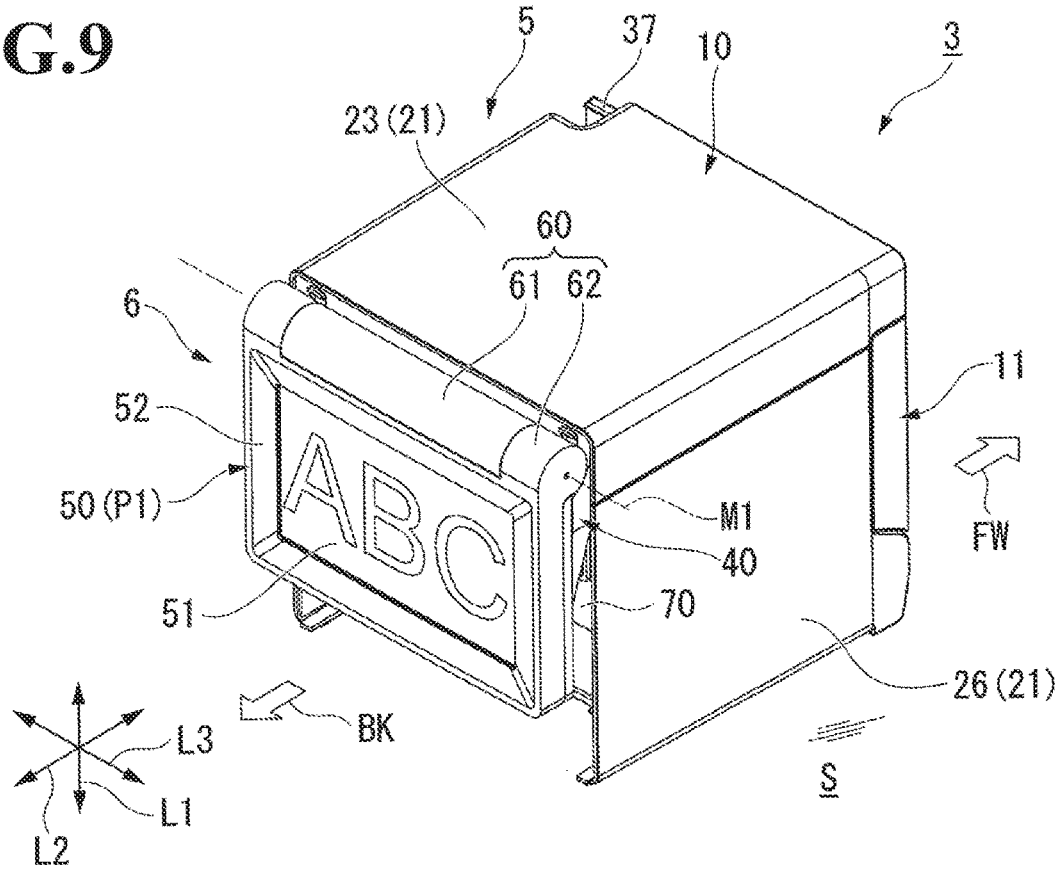
FIG. 9 is a perspective view of the thermal printer in a state in which the display portion main body illustrated in FIG. 4 is arranged so as to be overlapped with a fixing portion.
Figure 10:
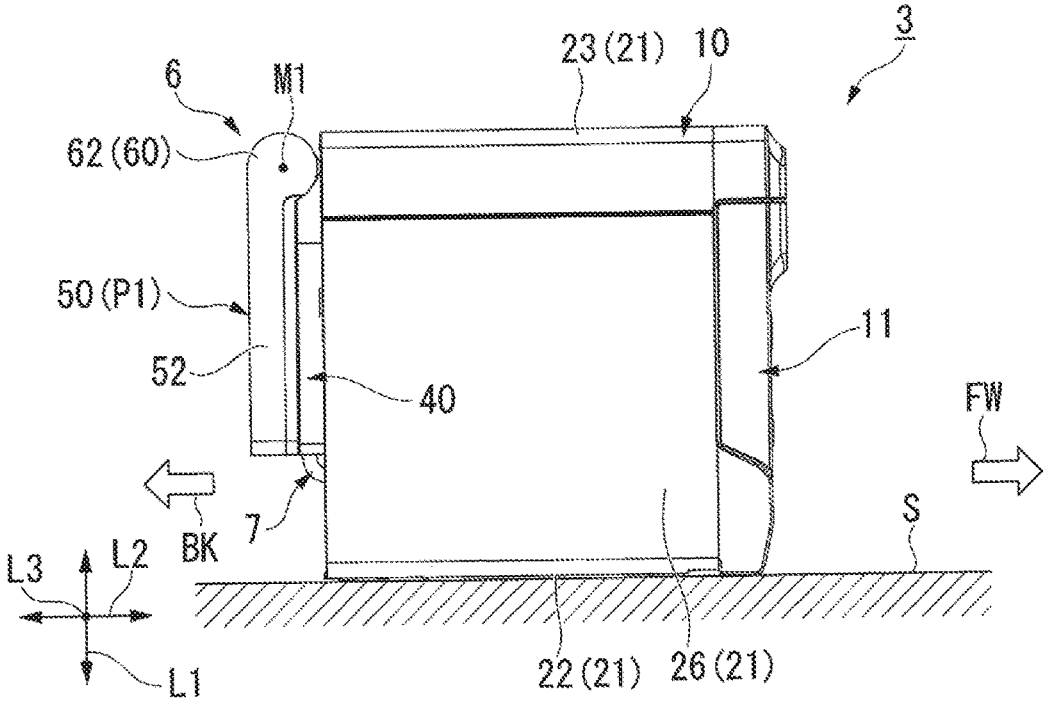
FIG. 10 is a side view of the thermal printer illustrated in FIG. 9.
Figure 11:
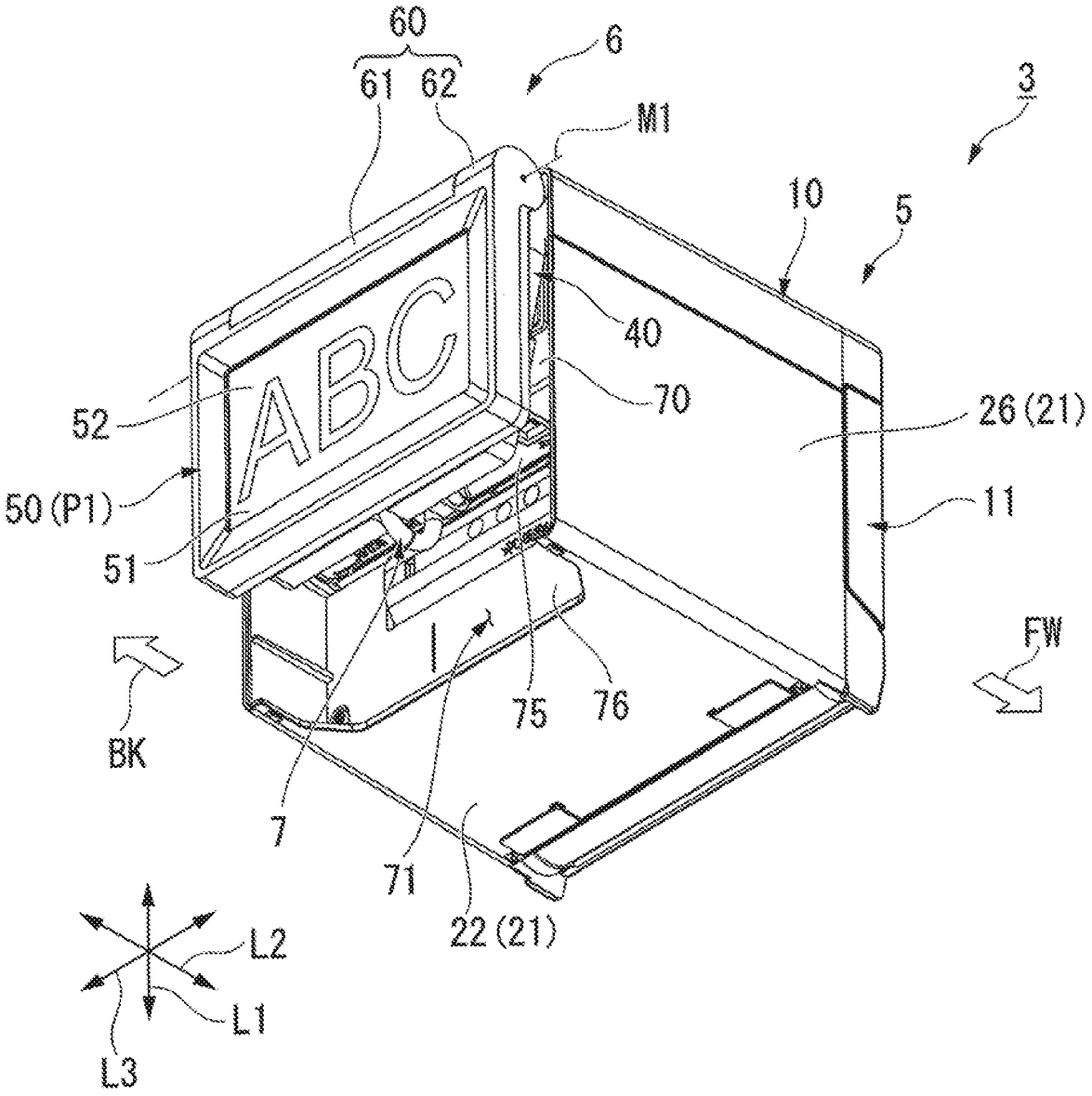
FIG. 11 is a perspective view of the thermal printer illustrated in FIG. 9 when viewed from the bottom surface side.

The display portion main body 50 coupled to the fixing portion 40 through intermediation of the hinge portion 60 having the configuration described above can be displaced by rotation about the rotation axis M1 between a first position P1 at which the display portion main body 50 is overlapped with the fixing portion 40 as illustrated in FIG. 9 to FIG. 11 and a second position P2 at which the display portion 51 is positioned above the top surface 23 of the casing 10 as illustrated in FIG. 12 to FIG. 15. Specifically, the display portion main body 50 is configured to be rotated within a rotation angle range of 180° about the rotation axis M1 from the first position P1 as illustrated in FIG. 12 to FIG. 15. The second position P2 is set to be a position at which the display portion main body 50 is rotated by 135° or more about the rotation axis M1 from the first position P1.

The hinge portion 60 includes therein an angle adjusting mechanism (not shown) configured to position the display portion main body 50 at a freely selected rotation angle when the display portion main body 50 is rotated about the rotation axis M1. Examples of the angle adjusting mechanism include a mechanism, which includes a damper mechanism configured to impart a predetermined rotation resistance force to the rotation shaft, and which is configured to hold the posture of the display portion main body 50 at a freely selected rotation angle in a non-step manner with the rotation resistance force. Further, another examples of the angle adjusting mechanism include a mechanism configured to hold the posture of the display portion main body 50 at any rotation angle in a stepwise manner through use of a change in mechanical load or the like.

As described above, the angle adjusting mechanism is provided in the hinge portion 60. Therefore, when the display portion main body 50 is set at a freely selected rotation angle by being rotated about the rotation axis M1, the display portion main body 50 can be maintained at that position.

The printer display device 6 having the configuration described above has a cable groove 80 formed therein as illustrated in FIG. 8 and FIG. 16 to FIG. 18. The USB cable 7 can be fitted and received in the cable groove 80. The USB cable 7 is laid up to a connecting portion with respect to the display case 52 in the display portion main body 50 under a state of being received in the cable groove 80.

The cable groove 80 includes a first cable groove 81, a second cable groove 82, and a third cable groove 83. The first cable groove 81 is formed in the hinge portion 60 so as to extend in the right-and-left direction L3 along the rotation axis M1. The second cable groove 82 is formed in the fixing portion 40. The third cable groove 83 is formed in a back surface (surface opposed to the fixing portion 40) of the display case 52.

The first cable groove 81 is formed so as to extend from a center part of the first hinge portion 61 in the right-and-left direction L3 to one of the second hinge portions 62. In the first cable groove 81, a groove portion formed in the first hinge portion 61 is referred to as "first groove portion 85", and a groove portion formed in one of the second hinge portions 62 is referred to as "second groove portion 86".

The first groove portion 85 is opened to the back side over the entire region of the first groove portion 85, and one groove end part side positioned in the center part of the first hinge portion 61 in the right-and-left direction L3 is further opened to the lower side. One groove end part of the first groove portion 85 functions as one groove end part 87 serving as the first cable groove 81. Another groove end part side of the first groove portion 85 is opened to one of the second groove portions 86 side along the right-and-left direction L3, and communicates to the second groove portion 86.

The second groove portion 86 is opened to the first groove portion 85 side along the right-and-left direction L3, and is opened to the display case 52 side. In particular, a part of the second groove portion 86 opened to the display case 52 side is to be changed in direction in association with rotation about the rotation axis M1 of the second hinge portion 62. Specifically, as illustrated in FIG. 8, when the display portion main body 50 is rotated by a rotation angle of 90° within a rotation angle range of from 60° to 120° about the rotation axis M1 from the first position P1 with respect to the fixing portion 40, the part of the second groove portion 86 opened to the display case 52 side is directed mainly toward the back side, and the direction thereof is matched with the direction of the opening of the first groove portion 85. In contrast, for example, as illustrated in FIG. 15, when the display portion main body 50 is rotated by a rotation angle of 180° about the rotation axis M1 from the first position P1 with respect to the fixing portion 40, the part of the second groove portion 86 opened to the display case 52 side is directed mainly toward the upper side, and the direction thereof is different from the direction of the opening of the first groove portion 85.

Figure 19:
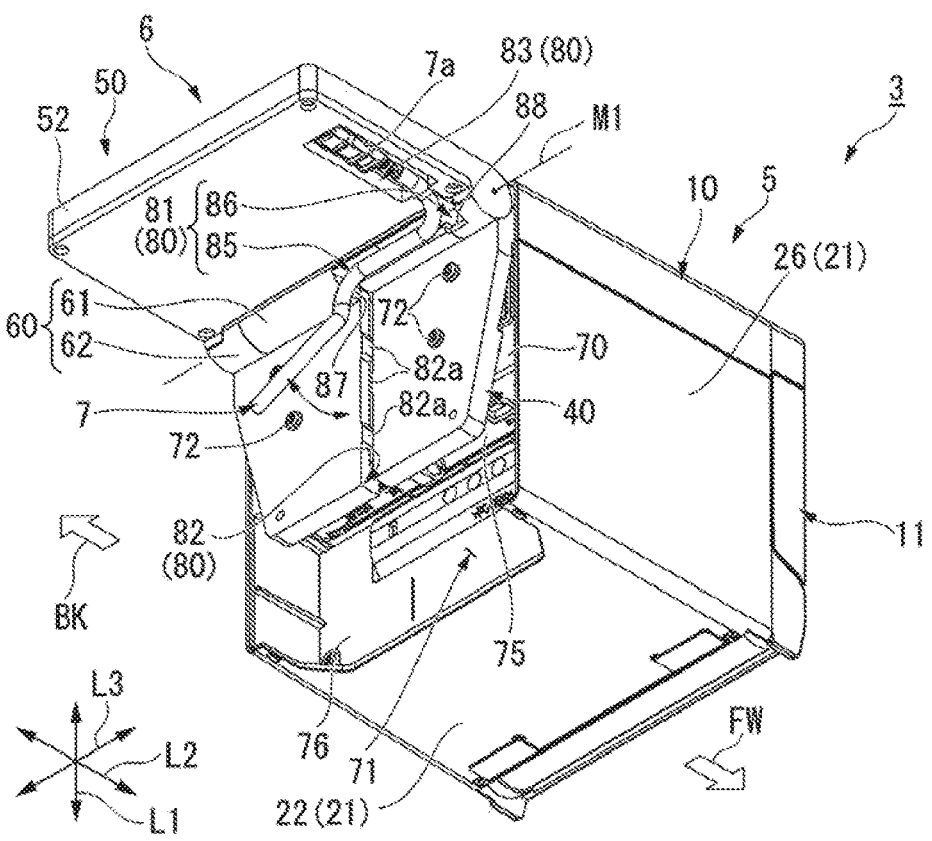
FIG. 19 is a perspective view of the thermal printer in a state in which a part of a USB cable is removed from a cable groove from the state illustrated in FIG. 8.
Figure 20:
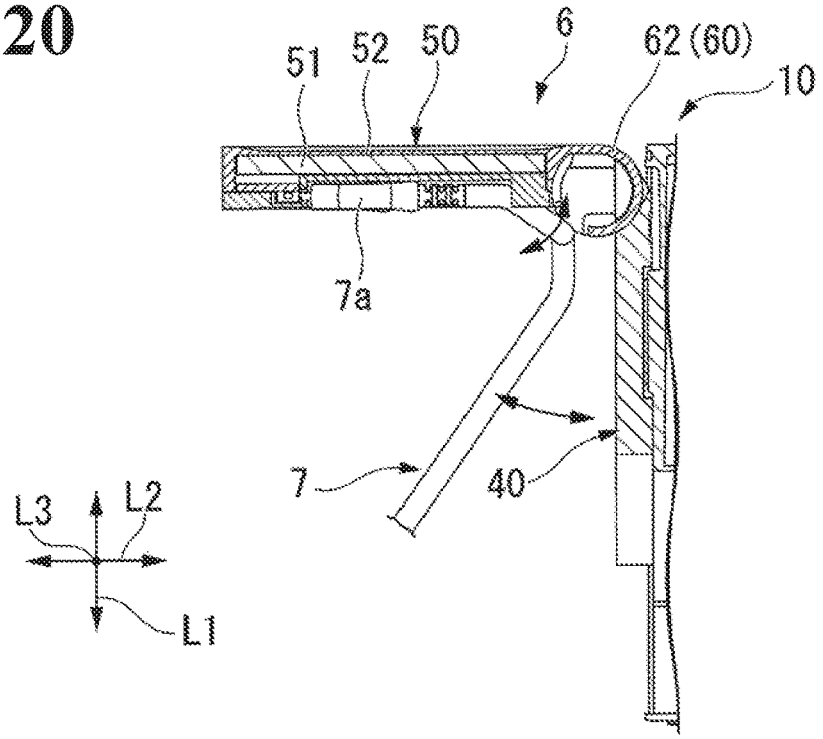
FIG. 20 is a vertical sectional view of the thermal printer in a state in which a part of the USB cable is removed from the cable groove from the state illustrated in FIG. 18.

As described above, when the display portion main body 50 is rotated by a predetermined specific rotation angle about the rotation axis M1 from the first position P1 with respect to the fixing portion 40, the part of the second groove portion 86 opened to the display case 52 side is directed in the same direction as a direction of the opening of the first groove portion 85. In this embodiment, the predetermined specific rotation angle is set so as to fall within the rotation angle range of from 60° to 120° as described above, more preferably the rotation angle range of from 90° to 120°. With this, as illustrated in FIG. 19 and FIG. 20, when the display portion main body 50 is rotated by a rotation angle of 90° about the rotation axis M1 from the first position P1, the USB cable 7 can be mounted to or removed from the first groove portion 85 and the second groove portion 86. The part of the second groove portion 86 opened to the display case 52 side functions as another groove end part 88 serving as the first cable groove 81.

The specific rotation angle may be determined in consideration of, for example, the relationships between a diameter of the USB cable 7 and the opening sizes of the first groove portion 85 and the second groove portion 86, in addition to the relationship between the direction of the opening of the first groove portion 85 and the direction of the opening of the second groove portion 86 as described above. In particular, when the rotation angle of the display portion main body 50 is an obtuse angle, the USB cable 7 can be more easily mounted or removed as compared to the case in which the rotation angle is an acute angle. Therefore, of the rotation angle range of from 60° to 120°, the rotation angle range of from 90° to 120° is particularly preferred.

Figure 15:
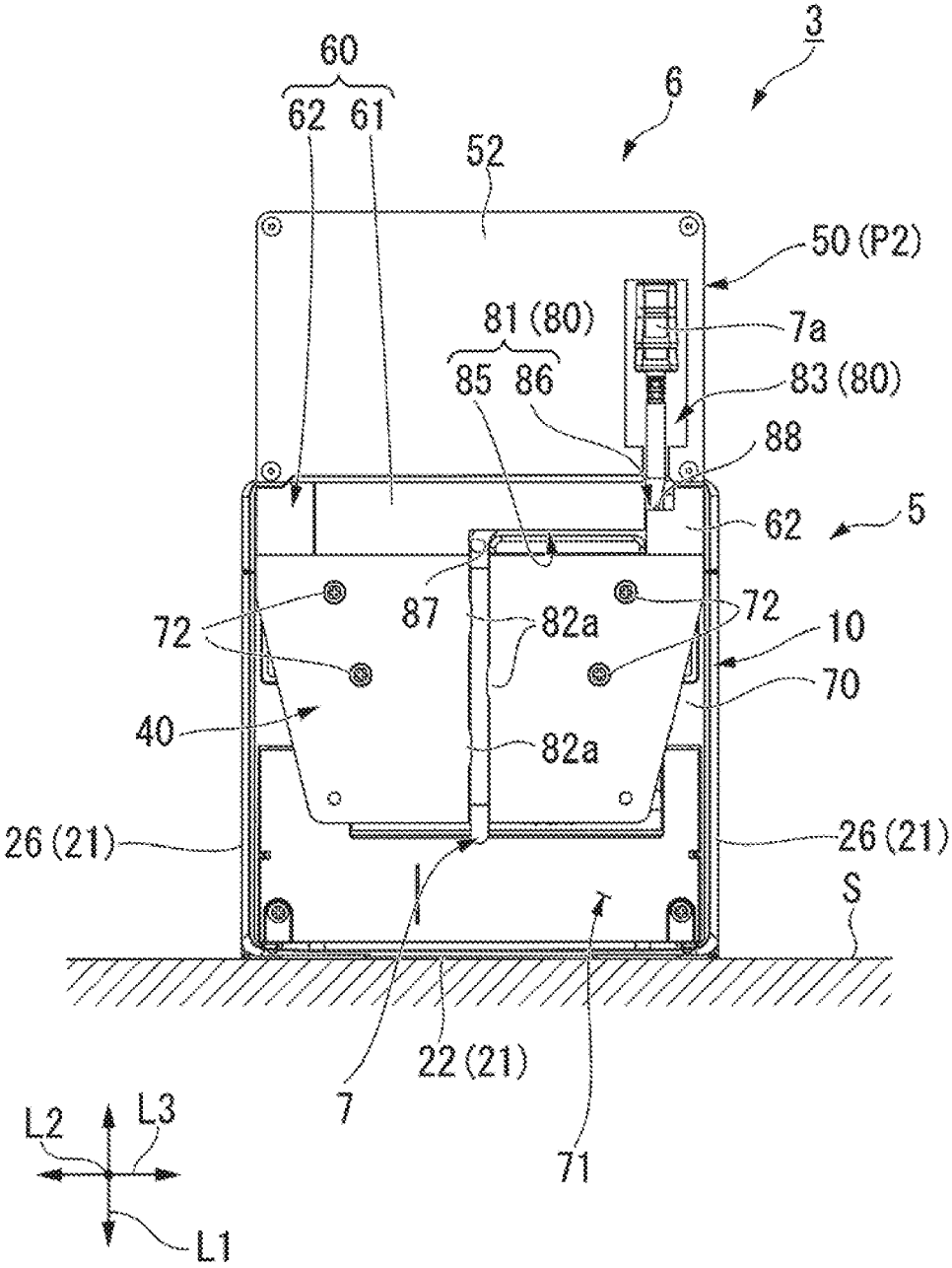
FIG. 15 is a rear view of the thermal printer illustrated in FIG. 12 when viewed from a back surface side.

As illustrated in FIG. 8 and FIG. 15, the second cable groove 82 is arranged in the center part of the fixing portion 40 in the right-and-left direction L3, and is formed so as to extend in the up-and-down direction over the entire surface of the fixing portion 40. A lower end part of the second cable groove 82 is opened to the lower side, and an upper end part of the second cable groove 82 communicates to the one groove end part 87 of the first cable groove 81.

The third cable groove 83 is formed so as to extend in the up-and-down direction on the back surface of the display case 52, and a lower end part of the third cable groove 83 communicates to the another groove end part 88 of the first cable groove 81. A groove width of the third cable groove 83 is set to such a size that the USB connector 7*a* can be received in the third cable groove 83. In the third cable groove 83, a female USB connector (not shown) to which the USB connector 7*a* of the USB cable 7 is connected is formed. Specifically, the third cable groove 83 is formed so as to communicate to the connecting portion between the USB cable 7 and the display portion main body 50.

The first cable groove 81, the second cable groove 82, and the third cable groove 83 are formed as described above. Therefore, the USB cable 7 can be smoothly fitted and received in the first cable groove 81, the second cable groove 82, and the third cable groove 83 in a sequential manner. Thus, the USB cable 7 can be laid.

As illustrated in FIG. 19, protruding wall portions 82*a* that slightly protrude in the right-and-left direction L3 are formed on wall surfaces opposed to each other in the right-and-left direction L3 of wall surfaces defining the second cable groove 82. With this, a groove width of the second cable groove 82 in a region in which the protruding wall portions 82*a* are formed is smaller than that of the second cable groove 82 in a region in which the protruding wall portions 82*a* are not formed. Thus, the USB cable 7 received in the second cable groove 82 is locally sandwiched through use of the protruding wall portions 82*a*, to thereby effectively prevent removal of the USB cable 7.

In the illustrated example, three protruding wall portions 82*a* are formed on the wall surfaces of the second cable groove 82 at intervals in the up-and-down direction. However, the present invention is not limited thereto, and the number and forming positions of the protruding wall portions 82*a* may be appropriately changed. Further, the protruding wall portion 82*a* is not required, and hence may not be formed.

Next, description is given of the case utilizing the thermal printer 3 having the configuration described above. As illustrated in FIG. 2 and FIG. 4, in the thermal printer 3, the printer cover 11 and the delivery slot 31 are arranged on the front surface 24 side of the casing 10, and the printer display device 6 is arranged on the back surface 25 side of the casing 10. Therefore, for example, the thermal printer 3 can be used in the following manner. The thermal printer 3 is installed at a store under a state in which the delivery slot 31 is directed toward the side of a staff of the store, and the printer display device 6 is directed toward the side of a customer who uses the store. Thus, the printed recording paper P can be given to the store staff side while various kinds of information is provided to the customer through use of the display portion 51. Therefore, a printer that is convenient and is excellent in operability can be obtained.

Further, the printer display device 6 is directly mounted to the back surface 25 side of the casing 10 so as to be separable therefrom. Therefore, the printer display device 6 can be held without use of the printer stand unlike the related art. Therefore, the installation space corresponding to the printer stand can be omitted, and the entire thermal printer 3 also including the printer display device 6 can be installed only in the installation space corresponding to the casing 10. Thus, the space can be saved, and the space at the store can be effectively utilized through efficient use of the space on the periphery of the thermal printer 3. Further, the printer stand is not required unlike the related art. Therefore, cost of components can be saved accordingly, and the cost of the entire thermal printer 3 can be saved.

In particular, in the printer display device 6, the fixing portion 40 and the display portion main body 50 having the display portion 51 provided thereon are coupled to each other through intermediation of the hinge portion 60, and the display portion main body 50 can be displaced relative to the fixing portion 40 through use of the hinge portion 60. With this, a direction of the display portion 51 can be suitably adjusted as required without changing the installation position of the thermal printer 3. Thus, the display portion 51 can be visually recognized with satisfactory visibility irrespective of the installation position, and for example, a display content (various kinds of information) can be clearly given to a store staff or a customer.

Figure 5:
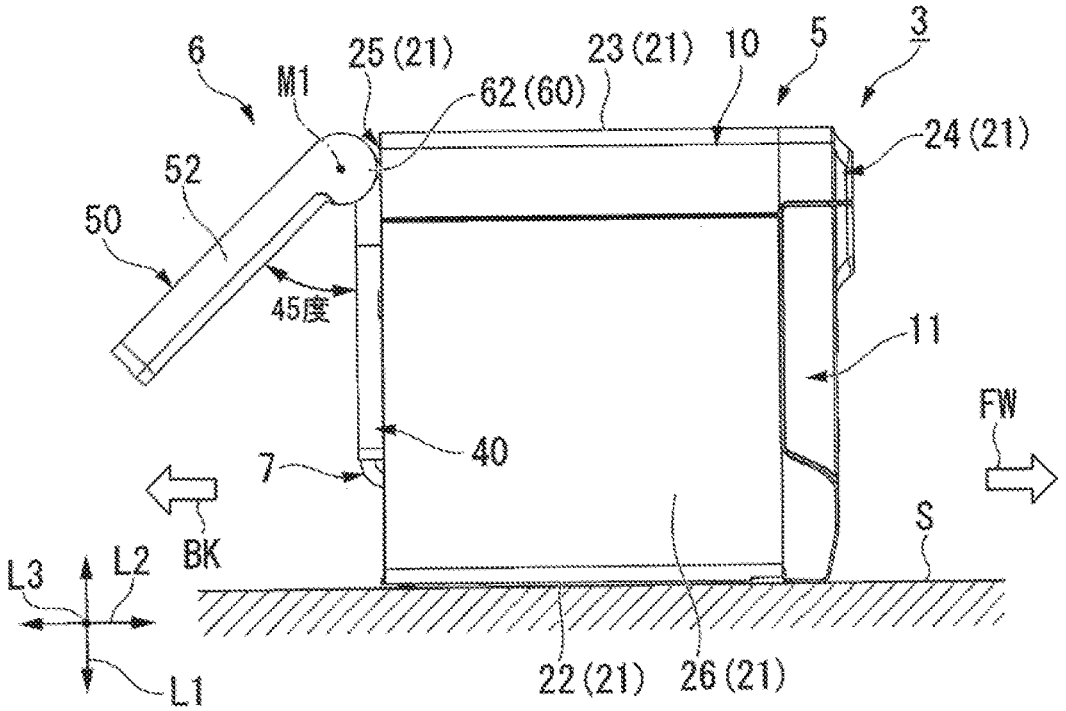
FIG. 5 is a side view of the thermal printer illustrated in FIG. 4.

The direction of the display portion 51 is described in more detail. The rotation axis M1 extends along the right-and-left direction L3, and hence the display portion main body 50 can be displaced relative to the fixing portion 40 while the display portion main body 50 is rotated upward or downward about the rotation axis M1. Accordingly, the angle can be adjusted so that the display portion 51 is directed toward the upper side while the display portion main body 50 is rotated so as to be opened to the upper side from the first position P1 illustrated in FIG. 9 to FIG. 11. As illustrated in FIG. 4 to FIG. 6, the display portion main body 50 can be set to a position at which the display portion main body 50 is rotated by 45° from the first position P1. With this, for example, the store staff can satisfactorily visually recognize the display portion 51 by directing a line of sight downward in a standing posture. Thus, the visibility of the printer display device 6 can be further enhanced.

Further, when the display portion main body 50 is further rotated about the rotation axis M1 to be displaced to a position rotated by 135° or more from the first position P1, that is, a position falling within an angle range of from 135° to 180°, the display portion main body 50 can be displaced to the second position P2 as illustrated in FIG. 12 to FIG. 15. FIG. 12 to FIG. 15 are each a view for illustrating a state in which the display portion main body 50 is rotated by 180° from the first position P1.

When the display portion main body 50 is displaced to the second position P2, the display portion 51 can be positioned above the top surface 23 of the casing 10. With this, the display portion 51 can be visually recognized from the delivery slot 31 side. As a result, a person (for example, store staff) who receives the printed recording paper P can visually recognize the display portion 51, and required information can be given to the person who receives the printed recording paper P. Thus, through displacement of the display portion main body 50 to the second position P2, a variety of methods of use, which cannot be achieved with the related-art printer stand, can be implemented, and the thermal printer 3 excellent in convenience can be obtained.

In particular, the display portion main body 50 can be rotated by 180° from the first position P1. Therefore, the display portion 51 is likely to be visually recognized more clearly from the delivery slot 31 side, and visibility can be further enhanced. In the case of the method of use in which the recording paper P printed by the thermal printer 3 is issued as a ticket to be received by a customer, for example, the customer can receive the ticket while visually recognizing the display portion 51.

Figure 12:
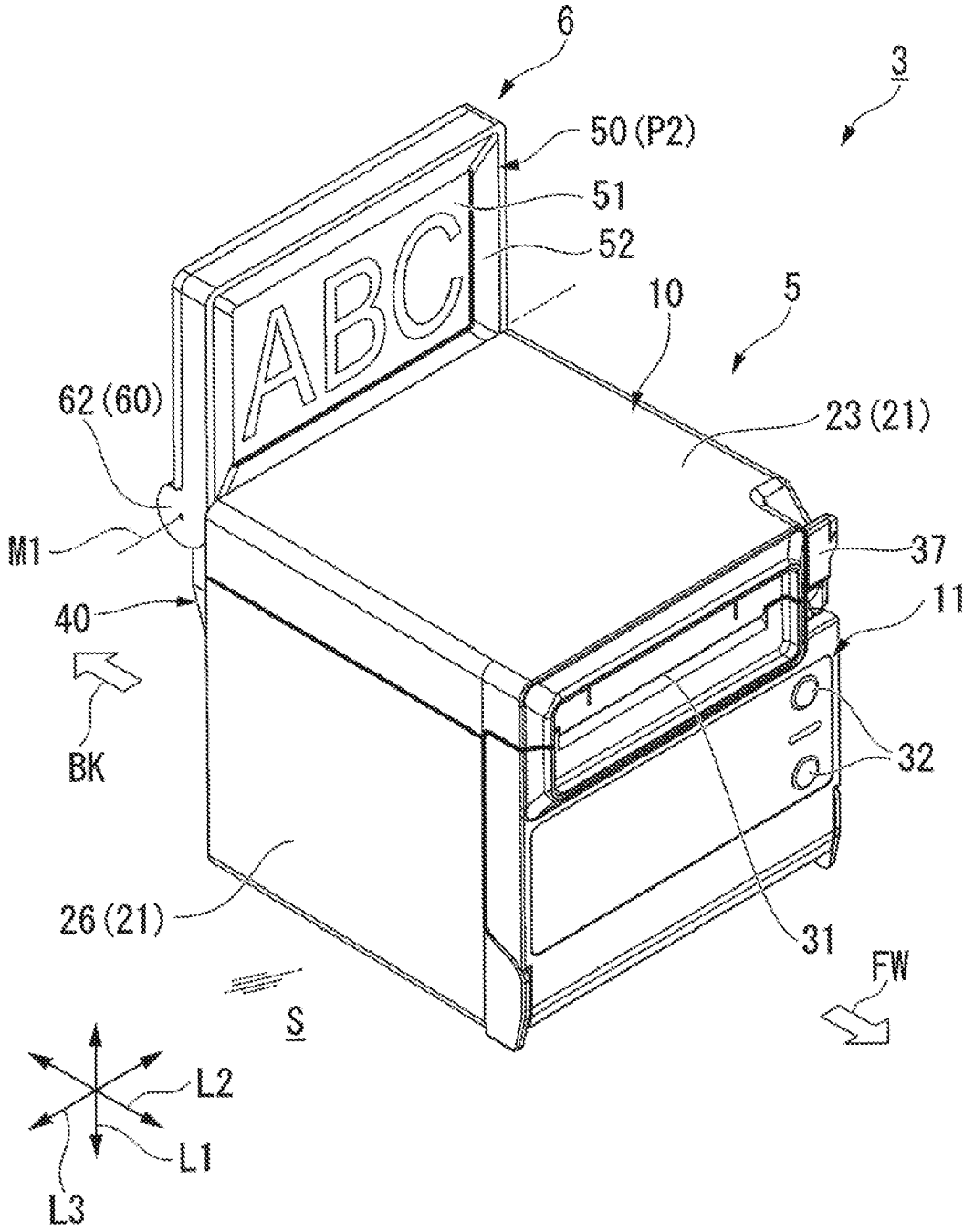
FIG. 12 is a perspective view of the thermal printer in a state in which the display portion main body illustrated in FIG. 9 is rotated upward by 180° with respect to the fixing portion.
Figure 13:
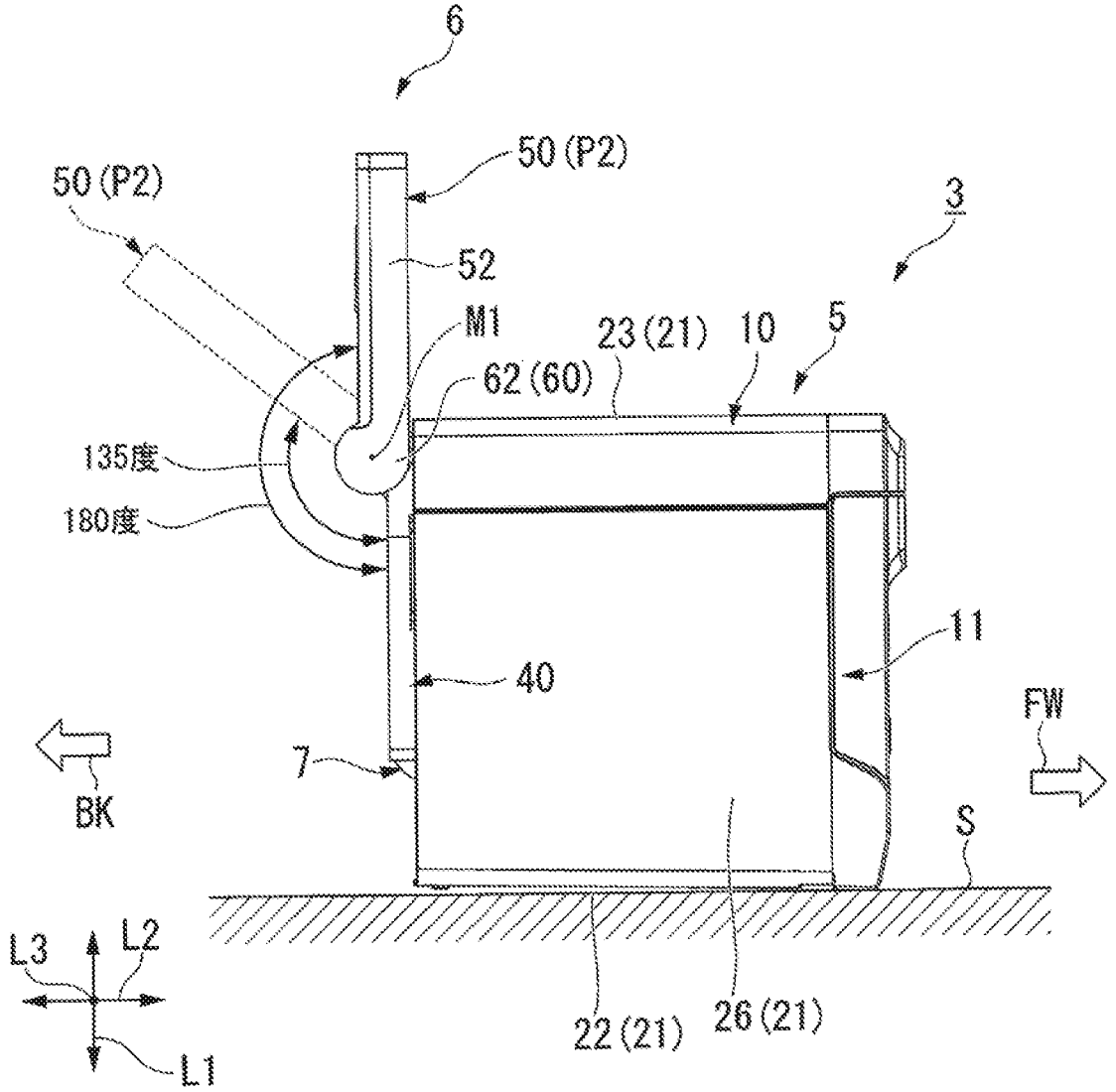
FIG. 13 is a side view of the thermal printer illustrated in FIG. 12.
Figure 14:
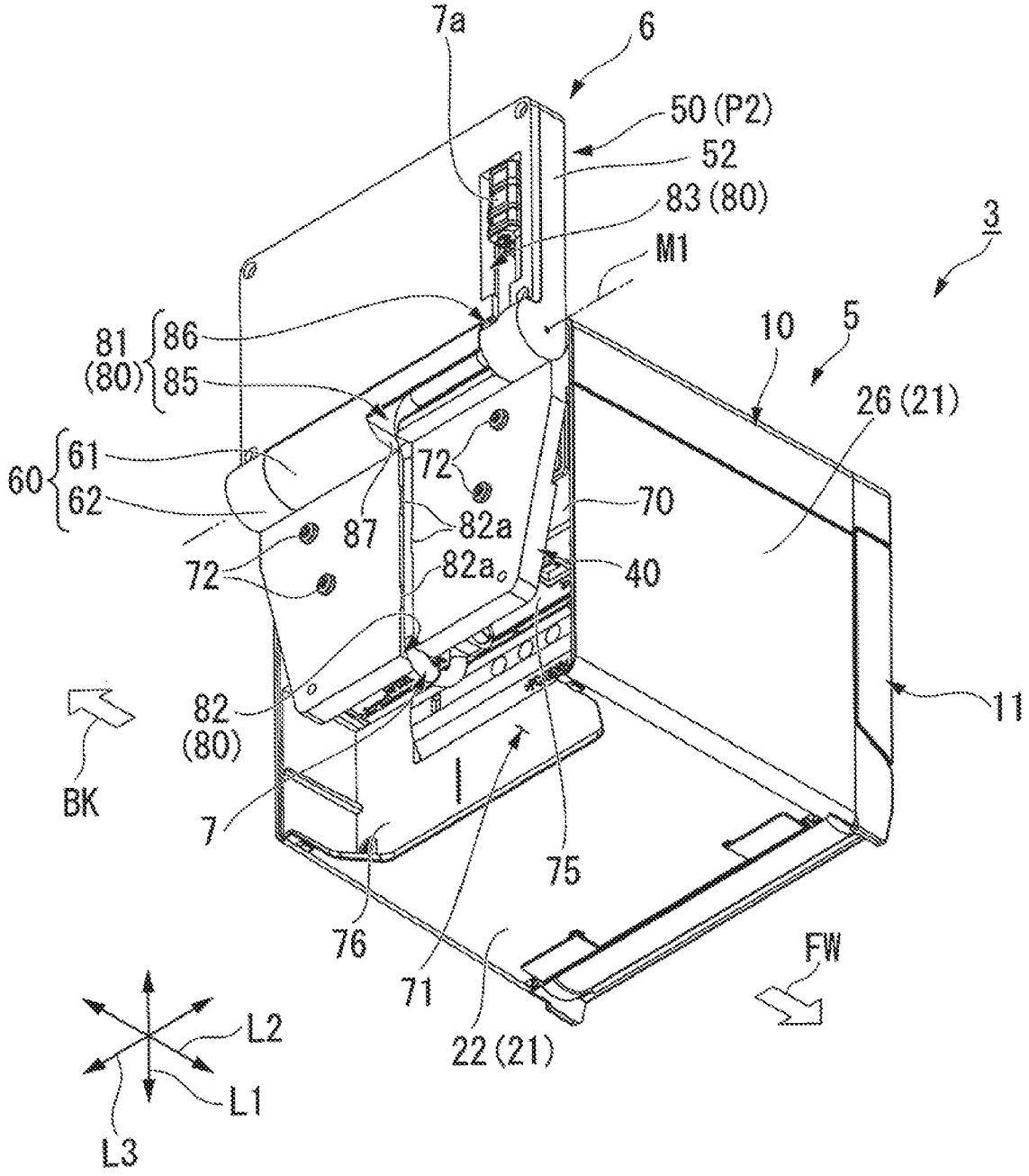
FIG. 14 is a perspective view of the thermal printer illustrated in FIG. 12 when viewed from the bottom surface side.

In addition, it is preferred to provide a function of automatically or suitably switching the vertical direction of a display content (various kinds of information) to be displayed on the display portion 51 in accordance with the rotation angle of the display portion main body 50. With this, for example, a display content ("ABC" in each figure) to be displayed on the display portion 51 can be appropriately inverted vertically as illustrated in FIG. 12. When the vertical direction of the display content is automatically switched, for example, it is only required to have a configuration in which a detection portion configured to detect the rotation angle of the hinge portion 60 is provided, and the display control portion 53 switches the vertical direction of the display content based on the detection result of the detection portion. In addition, when the vertical direction of the display content is suitably switched, for example, it is only required to have a configuration in which a switch and the like capable of performing an external operation are provided to the casing 10 or the display case 52, and the display control portion 53 switches the vertical direction of the display content based on switch-on or switch-off by the store staff or the like.

Further, as illustrated in FIG. 8, the cable groove 80 is formed in the printer display device 6 according to this embodiment. Therefore, the USB cable 7 can be fitted and received in the cable groove 80, and the USB cable 7 can be laid up to the connecting portion with respect to the printer display device 6. Thus, the USB cable 7 can be made inconspicuous, and exposure thereof to the outside can be prevented. With this, the USB cable 7 can be prevented from being tangled on the periphery of an installation position of the thermal printer 3, and satisfactory appearance can be ensured. Further, the contact with the USB cable 7 can be prevented. Therefore, for example, displacement and falling of the thermal printer 3 can be prevented, and unexpected dropping (removal) and the like of the USB cable 7 from the printer display device 6 can be prevented.

As described above, in the thermal printer 3 and the printer display device 6 in this embodiment, high visibility can be ensured, and space and cost can be saved. Further, exposure of the USB cable 7 can be prevented, and satisfactory appearance can be easily ensured. In addition, displacement, falling, dropping of the USB cable 7, and the like are made less liable to occur.

Further, in the printer display device 6 in this embodiment, the following action and effect can be exhibited. Specifically, the first cable groove 81 formed in the hinge portion 60 extends in the right-and-left direction L3 along the rotation axis M1. Therefore, a part of the USB cable 7 received in the first cable groove 81 is deformed so as to be twisted about the rotation axis M1 instead of being deformed so as to be curved in the up-and-down direction in association with rotation of the display portion main body 50. Thus, a large bending load (stress) is less liable to act on the USB cable 7 in association with rotation of the display portion main body 50, and disconnection can be effectively prevented. Thus, various kinds of information can be stably displayed on the display portion, and the thermal printer 3 in which reliability of operation is further improved can be obtained.

Further, as illustrated in FIG. 8, when the display portion main body 50 is rotated by a rotation angle of 90°, which is a predetermined specific rotation angle (within a rotation angle range of from 60° to 120°, more preferably from 90° to 120°), about the rotation axis M1 from the first position P1 with respect to the fixing portion 40, the opening of the first groove portion 85 and the opening of the second groove portion 86 are directed in the same direction (back side). Thus, as illustrated in FIG. 19 and FIG. 20, when the display portion main body 50 is rotated by a rotation angle of 90°, the USB cable 7 can be mounted to or removed from the first groove portion 85 and the second groove portion 86. As a result, an operation of fitting the USB cable 7 into the first cable groove 81 can be easily performed.

Further, when the rotation angle of the display portion main body 50 with respect to the fixing portion 40 is a rotation angle other than 90° that is a specific rotation angle, the opening of the second groove portion 86 can be directed in a direction different from that of the opening of the first groove portion 85. Thus, dropping of the USB cable 7 from the first cable groove 81 can be effectively prevented.

Figure 16:
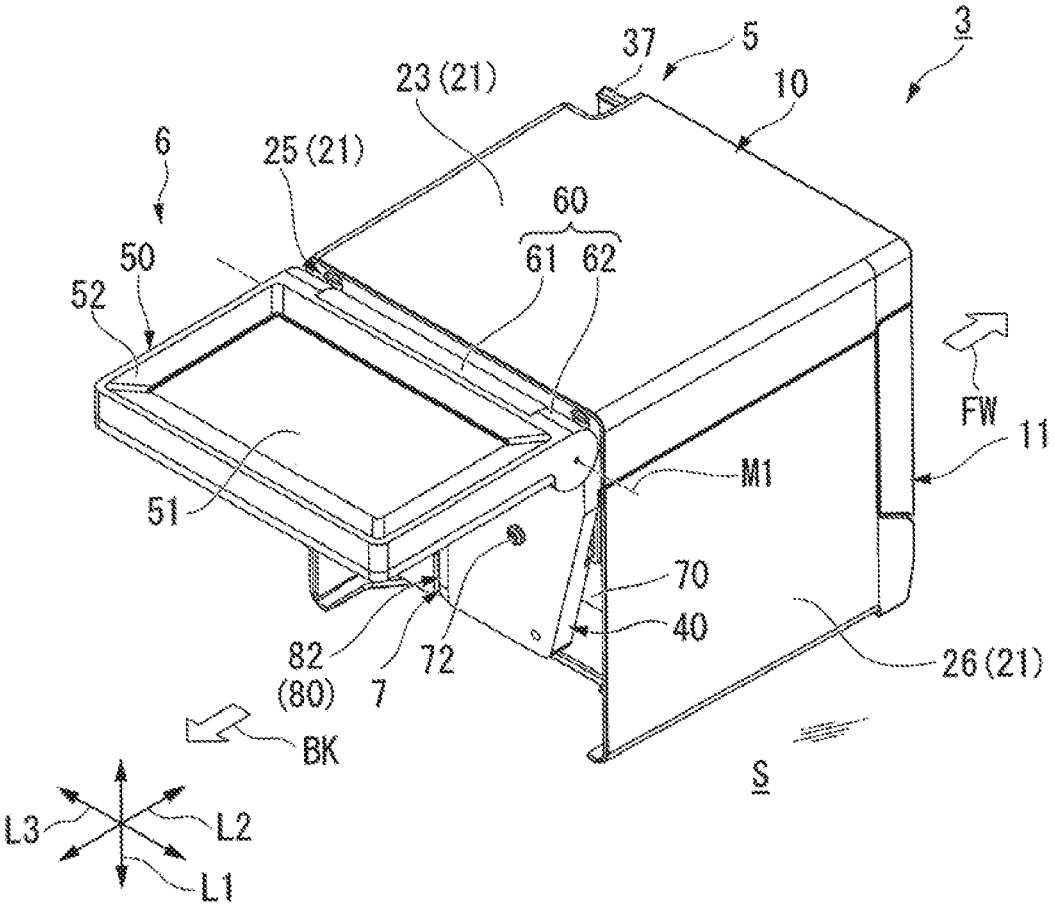
FIG. 16 is a perspective view of the thermal printer illustrated in FIG. 8 when viewed from a top surface side.
Figure 17:
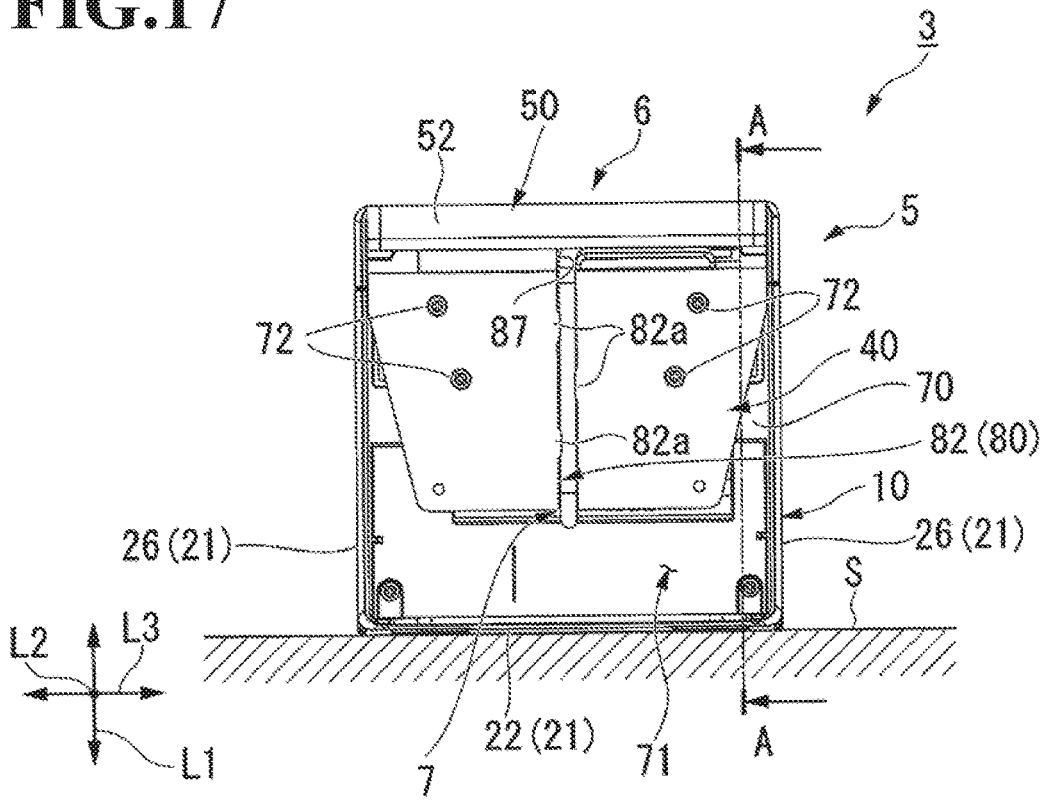
FIG. 17 is a rear view of the thermal printer illustrated in FIG. 16 when viewed from the back surface side.
Figure 18:
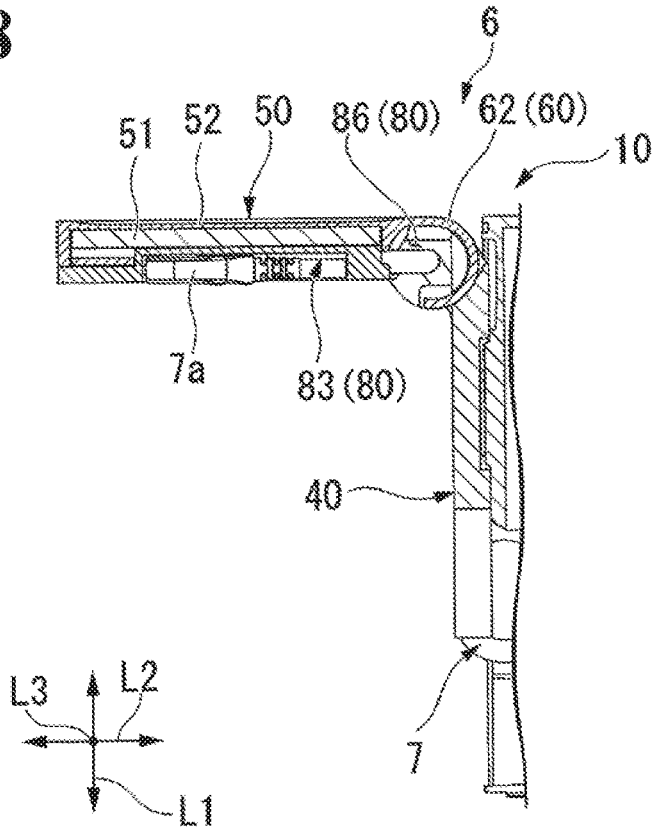
FIG. 18 is a vertical sectional view taken along the line A-A of FIG. 17.

In particular, as illustrated in FIG. 16, when the rotation angle of the display portion main body 50 with respect to the fixing portion 40 is 90°, the display portion 51 is directed right upward. Therefore, this rotation angle is set to an angle that is not actively selected at a time of use of the thermal printer 3. Specifically, the rotation angle that is not actively selected at a time of use of the thermal printer 3 is intentionally set to a specific rotation angle (within a rotation angle range of from 60° to 120°), to thereby enable mounting or removal of the USB cable 7. With this, the direction of the opening of the first groove portion 85 and the direction of the opening of the second groove portion 86 can be prevented from being matched with each other at a time of use of the thermal printer 3 in which a rotation angle other than the specific rotation angle is selected. Thus, dropping of the USB cable 7 from the first cable groove 81 can be effectively prevented at a time of use of the thermal printer 3.

Further, in the thermal printer 3 in this embodiment, the printer display device 6 can be separated and removed from the casing 10 by removing the fixing screws 72. With this, the printer display device 6 can also be installed independently under a state of being separated from the printer within a cable range of the USB cable 7.

Figure 21:
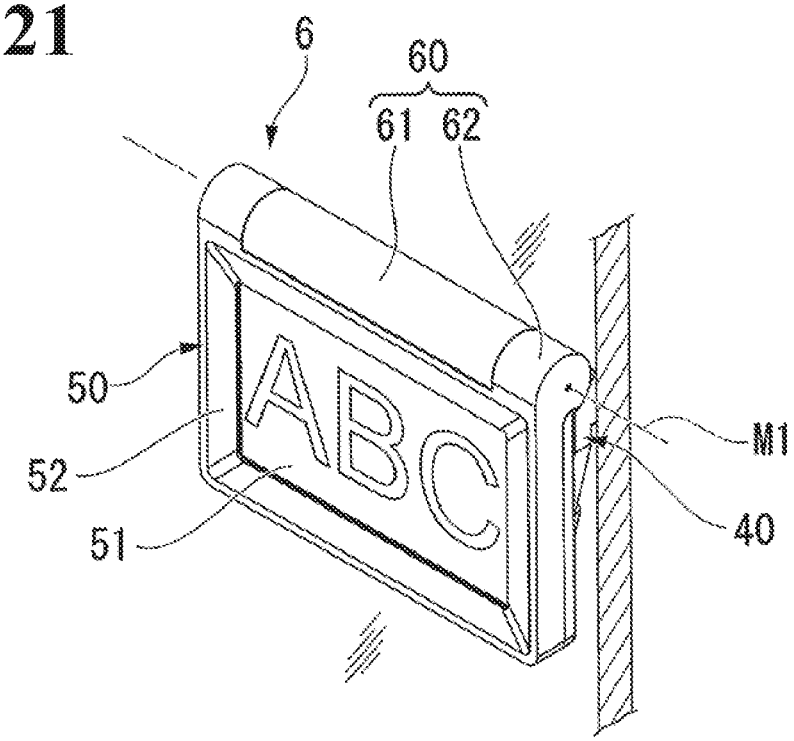
FIG. 21 is a perspective view of the printer display device in a state in which the printer display device removed in FIG. 7 is used under a condition of being fixed to a wall.
Figure 22:
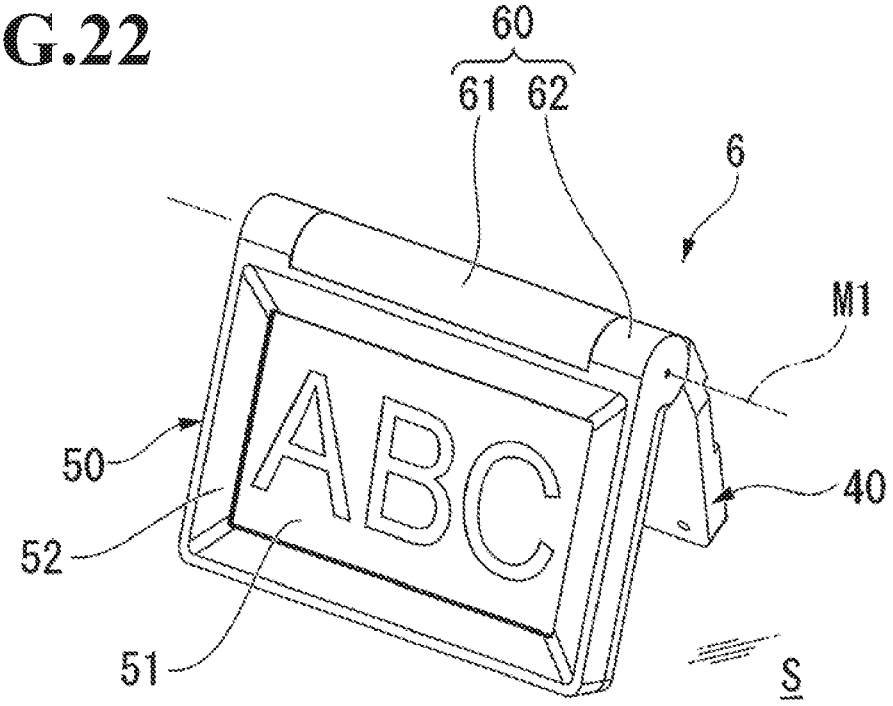
FIG. 22 is a perspective view of the printer display device in a state in which the printer display device removed in FIG. 7 is used under a condition of being installed on an installation surface.

Thus, for example, as illustrated in FIG. 21, the printer display device 6 can be used under a condition of being fixed to a wall as illustrated in FIG. 21. Alternatively, the printer display device 6 can be used under a condition of being installed on the installation surface S at a store so as to be adjacent to the thermal printer 3 as illustrated in FIG. 22. In FIG. 21 and FIG. 22, the thermal printer 3 and the USB cable 7 are omitted.

Figure 23:
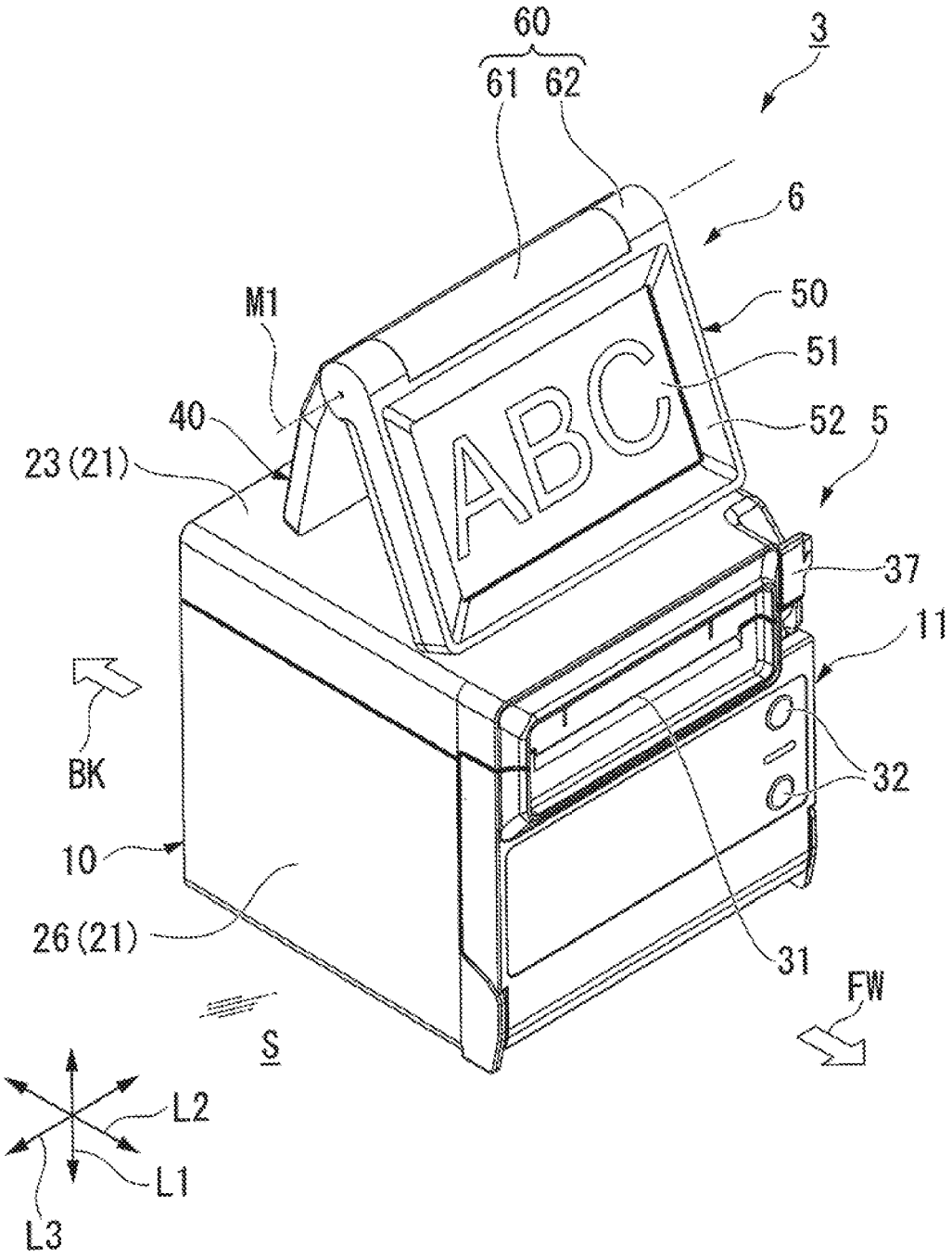
FIG. 23 is a perspective view of the thermal printer in a state in which the printer display device removed in FIG. 7 is used under a condition of being installed on a top surface of a casing.
Figure 24:
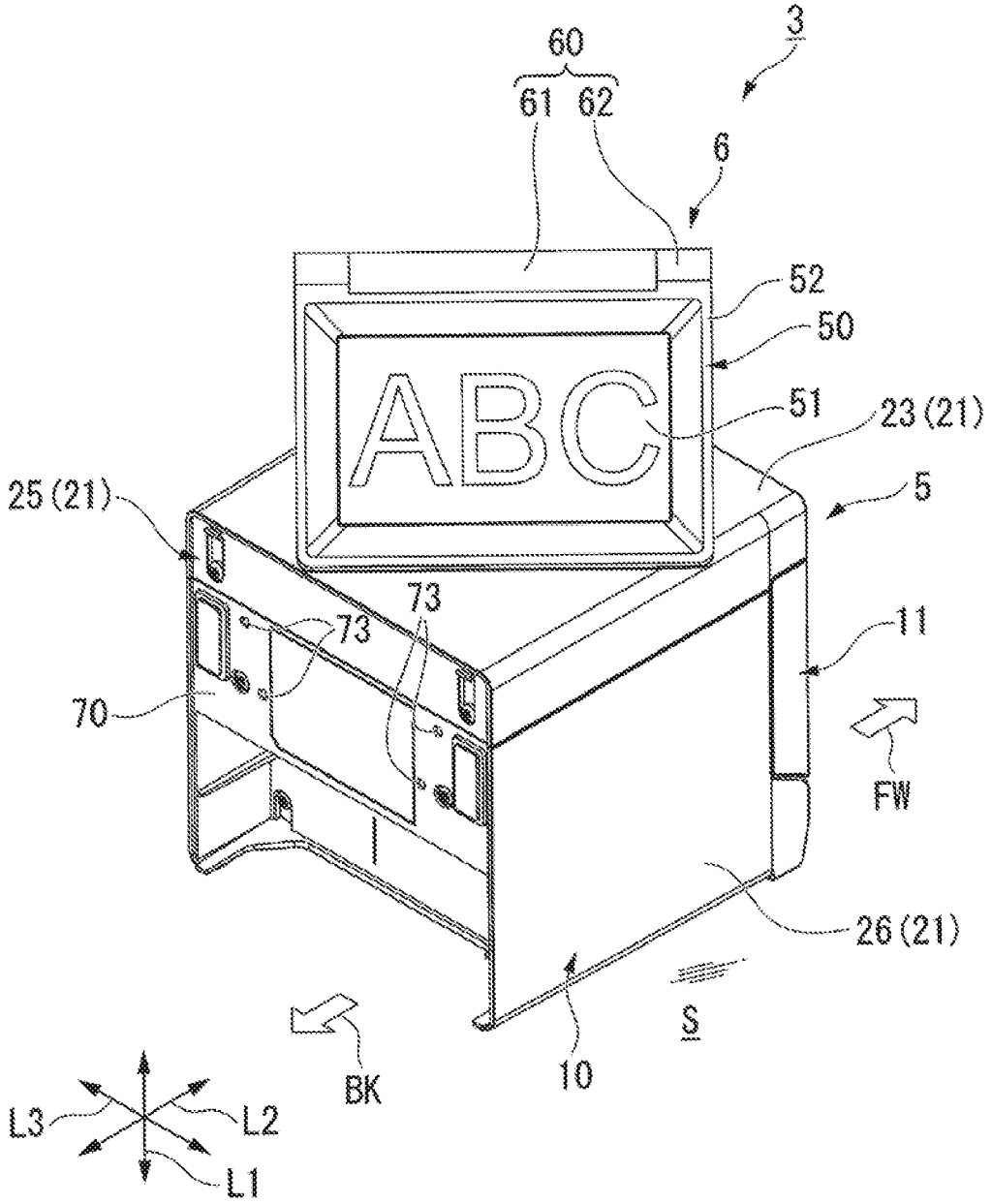
FIG. 24 is a perspective view of the thermal printer in a state in which the printer display device removed in FIG. 7 is used under a condition of being installed on the top surface of the casing.

Further, for example, the printer display device 6 can also be used under a condition of being installed on the top surface 23 of the casing 10 under a state in which the display portion 51 is directed toward the delivery slot 31 side as illustrated in FIG. 23. Alternatively, the printer display device 6 can also be used under a condition of being installed on the top surface 23 of the casing 10 under a state in which the display portion 51 is directed toward the back surface 25 side of the casing 10 as illustrated in FIG. 24. In FIG. 23 and FIG. 24, the USB cable 7 is omitted.

As described above, the printer display device 6 can also be used under a state of being removed from the casing 10. Therefore, the printer display device 6 can be used by a variety of methods of use depending on the situation, and the thermal printer 3, which is convenient and excellent in versatility and has a high degree of freedom for design, can be obtained.

The embodiments of the present invention have been described above. However, the embodiment is presented as an example and is not intended to limit the scope of the invention. The embodiment may be implemented in other various modes, and various kinds of omissions, replacements, and modifications can be made without departing from the gist of the invention. The embodiment and modification examples thereof include, for example, those which can be easily assumed by a person skilled in the art, those which are substantially the same, and those which fall within a scope of equivalence.

For example, in the above-mentioned embodiment, the description has been given of the example of the thermal printer 3 of a forward delivery type in which the recording paper P is delivered to the front side. However, the present invention is not limited thereto, and for example, a thermal printer of an upward delivery type in which the recording paper P is delivered to the upper side may be used. In addition, in the above-mentioned embodiment, the description has been given of the example of the thermal printer 3 as one example of a printer. However, the present invention is not limited thereto, and for example, an inkjet printer or the like, in which the recording paper P is printed through use of ink droplets, may be used.

Further, in the above-mentioned embodiment, the description has been given of the case in which the printer display device 6 is mounted to the back surface 25 side of the casing 10. However, the present invention is not limited thereto, and it is only required that the printer display device 6 be mounted to the outer surface 21 other than the bottom surface 22. For example, the printer display device 6 may be mounted to the top surface 23 or the side surface 26 of the casing 10.

Further, in the above-mentioned embodiment, the description has been given of the case in which the display control board 54 having the display control portion 53 mounted thereon is provided on the display portion main body 50 side. However, the present invention is not limited thereto. For example, a fixing portion may be formed as a fixing case including, inside thereof, the display control board 54 having the display control portion 53 mounted thereon, and only the display portion 51 may be provided to the display portion main body 50. In this case, it is only required that the USB cable 7 be connected to the fixing case side through use of, for example, a cable groove.

Further, in the above-mentioned embodiment, the description has been given of the case in which the printer display device 6 is mounted to the mounting surface 70 on the back surface 25 of the casing 10 through use of the fixing screws 72. However, the present invention is not limited to the fixing screws 72, and another means may be adopted as long as the printer display device 6 can be separably (removably) mounted to the mounting surface 70.

Figure 25:
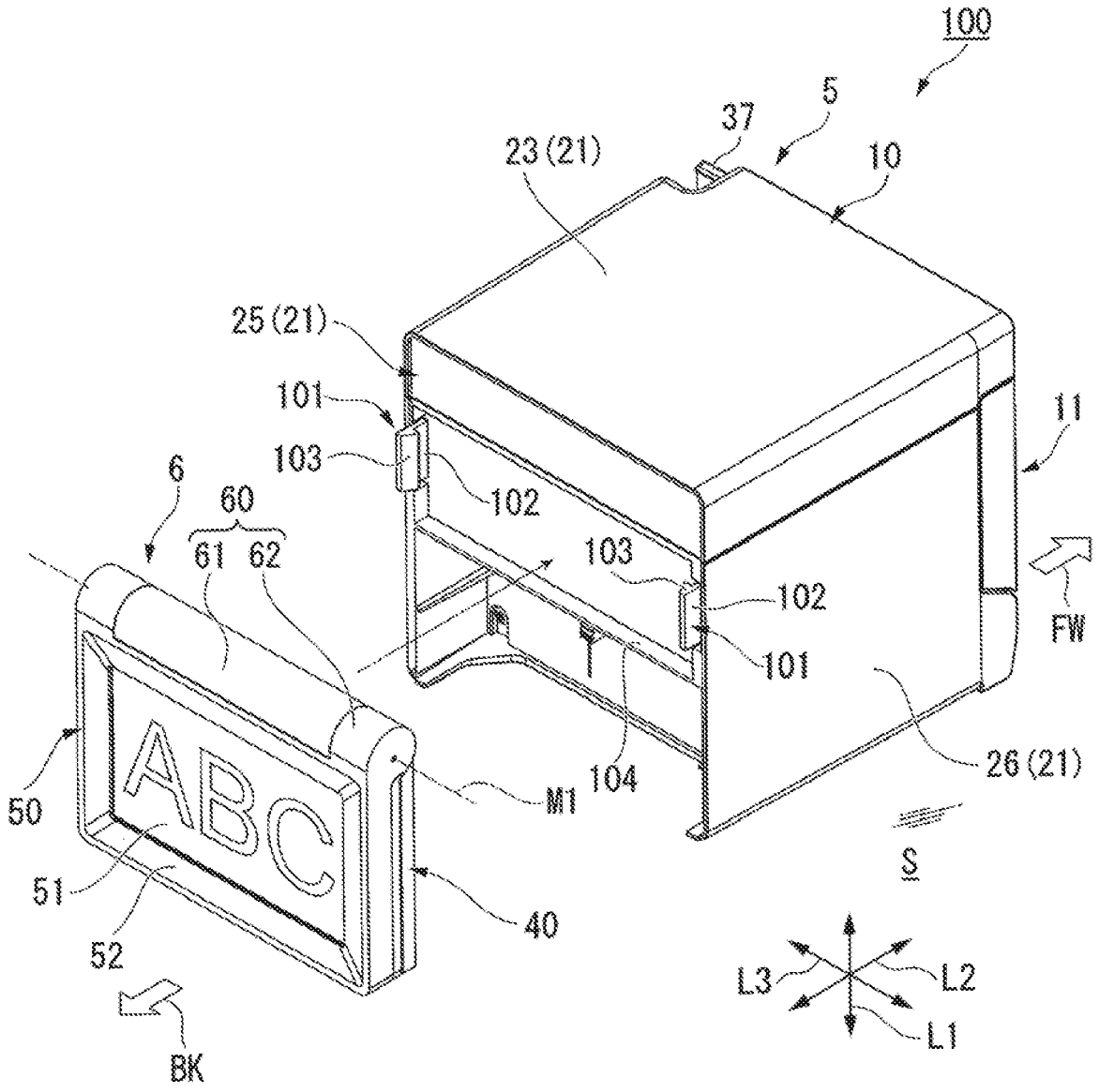
FIG. 25 is a perspective view of a modification example of the thermal printer according to the present invention in a state in which the printer display device is removed.

For example, as illustrated in FIG. 25, a pair of holding portions 101 arranged at an interval in the right-and-left direction L3 may be formed on the mounting surface 70 instead of the screw holes 73. The holding portions 101 each include a holding piece 102 that extends along the up-and-down direction L1 and protrudes to the back side and a locking protrusion 103 formed at a distal end of the holding piece 102, and can be elastically deformed in the right-and-left direction L3. The pair of holding portions 101 can hold the fixing portion 40 of the printer display device 6 so as to sandwich the fixing portion 40 from the right-and-left direction L3 through use of an elastic force.

Even in the case of the thermal printer 100 having the configuration described above, the printer display device 6 can be separably mounted to the mounting surface 70, and hence the same action and effect as those in each of the embodiments can be exhibited. In this case, it is preferred that a step 104 configured to support a lower end part of the fixing portion 40 from below be formed on the mounting surface 70.

Figure 26:
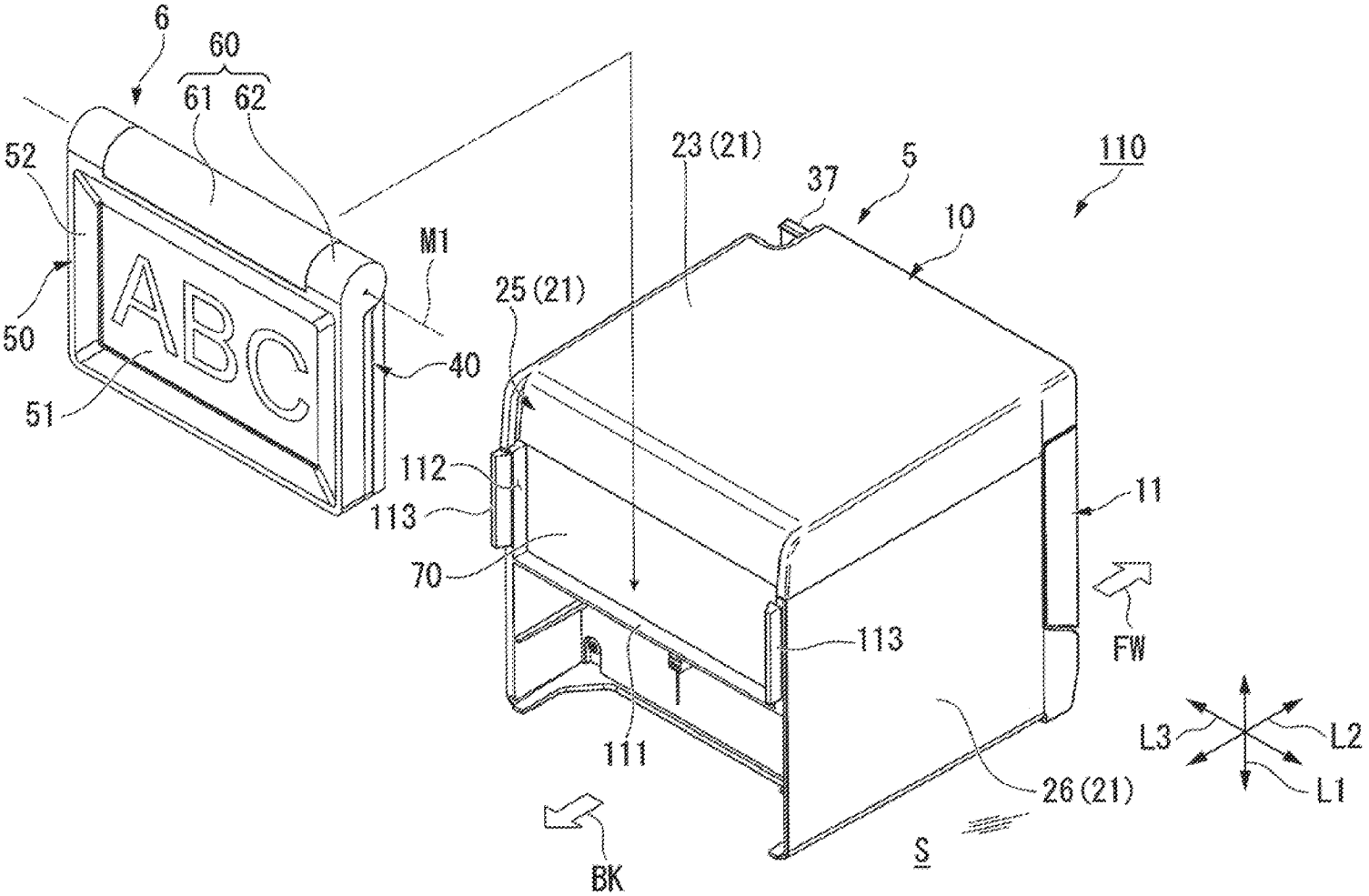
FIG. 26 is a perspective view of another modification example of the thermal printer according to the present invention in a state in which the printer display device is removed.

Further, as illustrated in FIG. 26, a step 111 configured to support the lower end part of the fixing portion 40 from below may be formed on the mounting surface 70, and a pair of guide pieces 113, which are each configured to define a slide groove 112 for allowing the fixing portion 40 to be slid and inserted from above between the guide piece 113 and the mounting surface 70, may be formed so as to extend in the up-and-down direction L1. Even in the case of a thermal printer 110 having the configuration described above, the printer display device 6 can be separably mounted to the mounting surface 70, and hence the same action and effect as those in each of the embodiments can be exhibited.

What is claimed is:

1. A printer, comprising:

a printer housing, which includes a plurality of outer surfaces including a bottom surface opposed to an installation surface, and has a recording paper receiving portion configured to receive recording paper through an opening portion;

a printer cover, which is coupled to the printer housing, and is configured to openably cover the opening portion;

a printer display device, which is removably mounted to an outer surface, of the plurality of outer surfaces, other than the bottom surface, and is configured to display predetermined information; and a connection cable, which is connected between the printer housing and the printer display device, and is configured to communicate at least data related to the predetermined information, wherein the printer display device has a cable groove in which the connection cable is fitted and received;

wherein the printer display device includes:

a fixing portion separably mounted to the outer surface;

a display portion main body, which has a display portion configured to display the predetermined information provided thereon, and to which the connection cable is connected;

a hinge portion, which has a rotation axis, and is configured to couple the fixing portion and the display portion main body to each other so that the display portion main body is rotated about the rotation axis with respect to the fixing portion, and wherein the cable groove includes:

a first cable groove formed in the hinge portion so as to extend along the rotation axis;

a second cable groove, which is formed in the fixing portion, and communicates to one groove end part of the first cable groove along a direction of the rotation axis; and a third cable groove, which is formed in the display portion main body, and communicates to another groove end part of the first cable groove along the direction of the rotation axis and communicates to a connecting portion between the connection cable and the display portion main body.

2. The printer according to claim 1, wherein the printer housing includes, as the plurality of outer surfaces, at least a front surface and a back surface opposed to each other, wherein the printer cover is provided on the front surface, and wherein the printer display device is separably mounted to the back surface.

3. The printer according to claim 2, wherein the hinge portion includes:

a first hinge portion formed integrally with the fixing portion; and a second hinge portion, which is formed integrally with the display portion main body and arranged so as to be adjacent to the first hinge portion in the direction of the rotation axis, and is coupled to the first hinge portion so as to be relatively rotated about the rotation axis, and wherein the first cable groove includes:

a first groove portion, which is formed in the first hinge portion, and communicates to the second cable groove; and a second groove portion, which is formed in the second hinge portion and coupled to the third cable groove, and has an opening that is to be changed in direction in association with rotation of the second hinge portion, and wherein the opening of the second groove portion is directed in the same direction as a direction of an opening of the first groove portion when the display portion main body is rotated by a predetermined specific rotation angle about the rotation axis with respect to the fixing portion.

4. The printer according to claim 3, wherein the rotation axis extends in parallel to each of the installation surface and the outer surface to which the printer display device is mounted.

5. The printer according to claim 4, wherein the printer housing further includes, as the plurality of outer surfaces, a top surface opposed to the bottom surface, and wherein the display portion main body is configured to be displaced by rotation about the rotation axis between a first position at which the display portion main body is overlapped with the fixing portion and a second position at which the display portion is positioned above the top surface.

6. The printer according to claim 5, wherein the display portion main body is configured to be rotated within a rotation angle range of 180° about the rotation axis from the first position, and wherein the second position is set to be a position at which the display portion main body is rotated by 135° or more about the rotation axis from the first position.

7. The printer according to claim 1, wherein the hinge portion includes:

a first hinge portion formed integrally with the fixing portion; and a second hinge portion, which is formed integrally with the display portion main body and arranged so as to be adjacent to the first hinge portion in the direction of the rotation axis, and is coupled to the first hinge portion so as to be relatively rotated about the rotation axis, and wherein the first cable groove includes:

a first groove portion, which is formed in the first hinge portion, and communicates to the second cable groove; and a second groove portion, which is formed in the second hinge portion and coupled to the third cable groove, and has an opening that is to be changed in direction in association with rotation of the second hinge portion, and wherein the opening of the second groove portion is directed in the same direction as a direction of an opening of the first groove portion when the display portion main body is rotated by a predetermined specific rotation angle about the rotation axis with respect to the fixing portion.

8. The printer according to claim 1, wherein the rotation axis extends in parallel to each of the installation surface and the outer surface to which the printer display device is mounted.

9. The printer according to claim 8, wherein the printer housing further includes, as the plurality of outer surfaces, a top surface opposed to the bottom surface, and wherein the display portion main body is configured to be displaced by rotation about the rotation axis between a first position at which the display portion main body is overlapped with the fixing portion and a second position at which the display portion is positioned above the top surface.

10. The printer according to claim 9, wherein the display portion main body is configured to be rotated within a rotation angle range of 180° about the rotation axis from the first position, and wherein the second position is set to be a position at which the display portion main body is rotated by 135° or more about the rotation axis from the first position.

11. A printer display device, which is separably mounted to a printer at an outer surface other than a bottom surface, and has at least data related to predetermined information communicated thereto through a connection cable connected between a printer housing and the printer display device, the printer including:

the printer housing, which includes a plurality of outer surfaces including the bottom surface opposed to an installation surface, and has a recording paper receiving portion configured to receive recording paper through an opening portion; and a printer cover, which is coupled to the printer housing, and is configured to openably cover the opening portion, the printer display device comprising:

a cable groove in which the connection cable is fitted and received;

a fixing portion separably mounted to the outer surface;

a display portion main body, which has a display portion configured to display the predetermined information provided thereon, and to which the connection cable is connected;

a hinge portion, which has a rotation axis, and is configured to couple the fixing portion and the display portion main body to each other so that the display portion main body is rotated about the rotation axis with respect to the fixing portion, and wherein the cable groove includes:

a first cable groove formed in the hinge portion so as to extend along the rotation axis;

a second cable groove, which is formed in the fixing portion, and communicates to one groove end part of the first cable groove along a direction of the rotation axis; and a third cable groove, which is formed in the display portion main body, and communicates to another groove end part of the first cable groove along the direction of the rotation axis and communicates to a connecting portion between the connection cable and the display portion main body.

* * * * *